United States Patent [19]

Brown et al.

[11] Patent Number: 4,863,528

[45] **Date of Patent: * Sep. 5, 1989**

[54] ALUMINUM ALLOY PRODUCT HAVING IMPROVED COMBINATIONS OF STRENGTH AND CORROSION RESISTANCE PROPERTIES AND METHOD FOR PRODUCING THE SAME

[75] Inventors: Melvin H. Brown, Morning Sun, Iowa; James T. Staley, Murrysville, Pa.; John Liu, Lower Burrell, Pa.; Sootae Lee, Export, Pa.

[73] Assignee: Aluminum Company of America, Pittsburgh, Pa.

[ * ] Notice: The portion of the term of this patent subsequent to Oct. 16, 2001 has been disclaimed.

[21] Appl. No.: 99,445

[22] Filed: Sep. 21, 1987

Related U.S. Application Data

[63] Continuation-in-part of Ser. No. 142,541, Apr. 21, 1980, abandoned, which is a continuation of Ser. No. 410,109, Oct. 26, 1973, abandoned.

[51] Int. Cl.[4] ..... C22F 1/04

[52] U.S. Cl. ..... 148/12.7 A; 148/159; 148/417; 148/418; 148/439

[58] Field of Search ..... 148/159, 2, 3, 11.5 A, 148/12.7 A, 415–418, 437–440

[56] References Cited

U.S. PATENT DOCUMENTS

| | | | |
|---|---|---|---|
| 2,248,185 | 7/1941 | Nock | 148/21.1 |
| 3,198,676 | 8/1965 | Sprowls et al. | 148/159 |
| 3,231,435 | 1/1966 | Rotsell et al. | 148/159 |
| 3,287,185 | 11/1966 | Vachet et al. | 148/159 |
| 3,305,410 | 2/1967 | Sublett et al. | 148/159 |
| 3,563,814 | 2/1971 | Lyle et al. | 148/12.7 |
| 3,645,804 | 2/1972 | Ponchel | 148/128 |
| 3,836,405 | 9/1974 | Staley et al. | 148/12.7 |
| 3,856,584 | 12/1974 | Cina | 148/159 |
| 3,881,966 | 5/1975 | Staley et al. | 148/12.7 |

(List continued on next page.)

FOREIGN PATENT DOCUMENTS

| | | |
|---|---|---|
| 1206354 | 6/1986 | Canada . |
| 58-061246 | 4/1983 | Japan . |
| 58-113342 | 7/1983 | Japan . |
| 60-013047 | 1/1985 | Japan . |
| 60-180637 | 9/1985 | Japan . |
| 61-238937 | 10/1986 | Japan . |
| 61-259828 | 11/1986 | Japan . |
| 62-063641 | 3/1987 | Japan . |
| 61-142753 | 6/1987 | Japan . |
| 473759 | 10/1975 | U.S.S.R. . |
| 1476942 | 6/1977 | United Kingdom . |
| 1480351 | 7/1977 | United Kingdom . |

OTHER PUBLICATIONS

"Precipitation Hardening and Stress Corrosion in $AlZnMg_3$", W. Gruhl et al., *Z. Metallkunde*, vol. 55, No. 10, pp. 577–582, (1964).

(List continued on next page.)

*Primary Examiner*—R. Dean

*Attorney, Agent, or Firm*—Carl R. Lippert; Daniel A. Sullivan, Jr.; Gary P. Topolosky

[57] ABSTRACT

There is disclosed a method for producing an aluminum alloy product and the resulting product having improved combinations of strength and corrosion resistance. The method includes providing an alloy consisting essentially of about 6–16% zinc, about 1.5–4.5% magnesium, about 1–3% cooper, one or more elements selected from zirconium, chromium, manganese, titanium, vanadium and hafnium, the total of said elements not exceeding about 1%, the balance aluminum and incidental impurities. The alloy is then solution heat treated; precipitation hardened to increase its strength to a level exceeding the as-solution heat treated strength level by at least about 30% of the difference between as-solution heat treated strength and peak strength; subjected to treatment at a sufficient temperature or temperatures for improving its corrosion resistance properties; and again precipitation hardened to raise its yield strength and produce a high strength, highly corrosion resistant alloy product.

133 Claims, 4 Drawing Sheets

U.S. PATENT DOCUMENTS

| | | | |
|---|---|---|---|
| 3,945,861 | 3/1976 | Anderson et al. | 148/12.7 |
| 3,947,297 | 3/1976 | Reimann et al. | 148/159 |
| 4,063,936 | 12/1977 | Nagase et al. | 75/141 |
| 4,069,072 | 1/1978 | Develay et al. | 148/32 |
| 4,126,448 | 11/1978 | Moore et al. | 75/146 |
| 4,189,334 | 2/1980 | Dubost et al. | 148/159 |
| 4,193,822 | 3/1980 | Adam et al. | 148/3 |
| 4,200,476 | 4/1980 | Dubost et al. | 148/12.7 |
| 4,305,763 | 12/1981 | Quist et al. | 148/12.7 |
| 4,345,951 | 8/1982 | Coupry et al. | 148/2 |
| 4,431,467 | 2/1984 | Staley et al. | 148/159 |
| 4,477,292 | 10/1984 | Brown | 148/20 |
| 4,629,517 | 12/1986 | Lifka et al. | 148/12.7 |
| 4,732,610 | 3/1988 | Hildeman et al. | 420/532 |

OTHER PUBLICATIONS

"Thermomechanical Treatments on High Strength Al—Zn—Mg(—Cu) Alloys", *Metallurgical Transactions,* vol. 4, pp. 1133–1144, (Apr. 1973).

"New Technique for Reducing Susceptibility to Stress--Corrosion of High Strength Aluminum Alloys", Published by the Pittsburgh Chapter of the American Society for Metals, (1974).

"A New Approach to the Problem of Stress Corrosion Cracking in 7075-T6 Aluminum", *Canadian Aeronautics and Space Journal,* vol. 27, No. 3, pp. 222–232, (1981).

"Microstructural Study of a High-Strength Stress-Corrosion Resistant 7075 Aluminum Alloy", *Journal of Materials Science,* vol. 17, pp. 2817–2824, (1982).

"Retrogression and Reaging Response of 7475 Aluminum Alloy", *Metals Technology,* vol. 10, pp. 386–392, (Oct. 1983).

J. T. Staley, Investigation to Improve the Stress-Corrosion Resistance of Aluminum Aircraft Alloys Through Alloy Additions and Specialized Heat Treatment, Under NAVAIR Contract N00019-68-C-0146, Oct. 1, 1972.

ALUMINUM ALLOY PRODUCT HAVING IMPROVED COMBINATIONS OF STRENGTH AND CORROSION RESISTANCE PROPERTIES AND METHOD FOR PRODUCING THE SAME

CROSS-REFERENCE TO RELATED APPLICATIONS

This is a continuation-in-part of pending U.S. application Ser. No. 142,541, filed on Apr. 21, 1980, which is a continuation of U.S. application Ser. No. 410,109, now abandoned, the disclosures of which are fully incorporated herein by reference.

BACKGROUND OF THE INVENTION

The present invention relates to a method for thermally treating articles containing an alloy based on aluminum and to improved alloy products produced by this method.

The precipitation-hardened aluminum alloy 7075, and other 7XXX alloys, in the T6 temper have not given sufficient resistance to corrosion under certain service conditions. The T7-type tempers improve the resistance of these alloys to stress corrosion cracking, but decrease strength significantly vis-a-vis the T6 condition.

SUMMARY OF THE INVENTION

An object of the present invention is to provide a new heat treating method to produce an aluminum alloy in a unique heat treated condition for providing favorable resistance to corrosion combined with high strength.

Another object is to provide an aluminum-based alloy product having at least about 5% greater yield strength than a similarly sized 7X50 alloy product in the T6 condition in combination with corrosion resistance properties which meet or exceed those of 7X50 alloy in a T7-type temper, for instance the T76 condition.

These objects, as well as other objects which will become apparent in the discussion which follows, are achieved according to the present invention by the herein-described method of thermally treating an article composed of an alloy consisting essentially of aluminum, about 4 or 6 to 16% zinc, about 1.5 to 4.5% magnesium, about 1 to 3% copper, and one or more elements selected from the group consisting of up to about 0.2% zirconium, up to about 0.25% chromium, up to about 0.8% manganese, up to about 0.2% vanadium and up to about 0.5% hafnium. All composition percentages herein are by weight percent unless indicated otherwise. Improved products in accordance with the invention exhibit very high strength combined with good exfoliation corrosion and stress corrosion cracking resistance. The method includes the steps of solution heat treating the article, then precipitation hardening the article at 175° to 325° F., then subjecting the article to a time and temperature within the perimeter ABCD of FIG. 4 or JKLM of FIG. 5, and then again Precipitation hardening at 175° to 325° F.

BRIEF DESCRIPTION OF THE DRAWING

FIG. 1 shows a prior art solution heat treated and stress relieved condition referred to as the W51 condition.

FIG. 2 shows the Prior art Precipitation-hardened condition referred to as the T6 condition.

FIG. 3 shows the Prior art stress corrosion cracking resistant condition referred to as the T73 condition.

DESCRIPTION OF THE PREFERRED EMBODIMENTS

Figure 1:
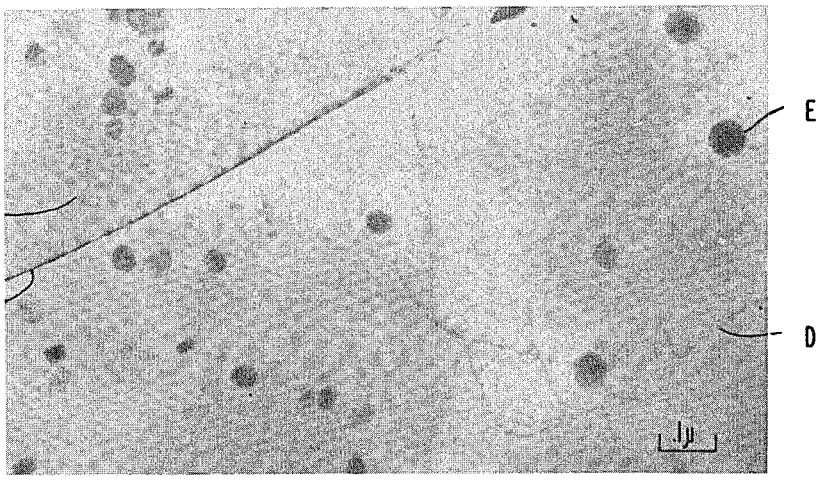
FIG. 1 (PRIOR ART)
FIGS. 1–3 are transmission electron micrographs of sections in a plate of aluminum alloy 7075. The distance equivalent to 0.1 micron is indicated on the micrographs. The metal surfaces reproduced in the micrographs all were perpendicular to the direction of rolling of the plate.

Alloys in the present invention have a composition containing 4 to 8% zinc, 1.5 to 3.5% magnesium, 1 to 2.5% copper, and at least one element selected from the group made up by chromium at 0.05 to 0.3%, manganese at 0.1 to 0.5%, and zirconium at 0.05 to 0.3%. The balance of the composition is essentially aluminum.

Alloys designated 7075 by the aluminum industry are preferred for one embodiment of the present invention and have a composition containing 5.1 to 6.1% zinc, 2.1 to 2.9% magnesium, 1.2 to 2.0% copper, 0.18 to 0.35% chromium, 0.30% maximum manganese, 0.40% maximum silicon, 0.50% maximum iron, 0.20% maximum titanium, others each 0.05% maximum and others total 0.15% maximum, balance aluminum.

The alloys used in the present invention may also contain one or more of the group of grain refining elements including titanium at 0.01 to 0.2% and boron at 0.0005 to 0.002%. These elements serve to produce a fine grain size in the cast form of the alloy. This is generally advantageous to mechanical properties.

In addition, it may be helpful to add 0.001 to 0.005% beryllium for the purpose of minimizing oxidation at times when the alloy is molten.

Iron and silicon are generally present as impurities. Up to 0.5% iron can be tolerated, and the silicon content should not exceed 0.4%, in order to avoid the formation of any substantial amount of the intermetallic compound $Mg_2Si$.

Figure 4:
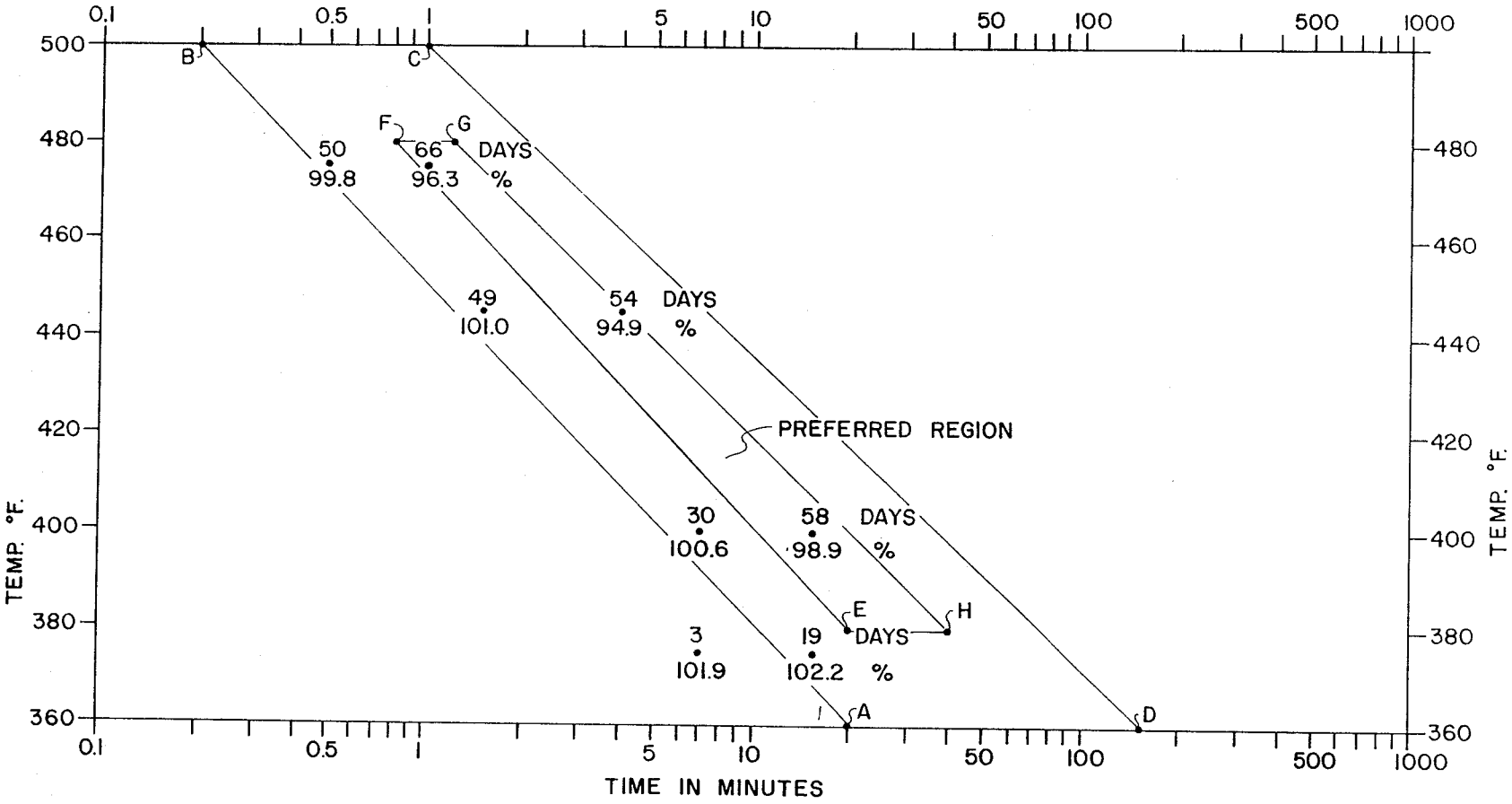
FIG. 4 is a graph showing characteristics of the invention.

A preferred heat treatment according to the present invention for obtaining improved stress-corrosion resistance is to immerse the alloy, as above defined, in the precipitation-hardened, T6 condition into molten metal for a time and temperature within the perimeter of the quadrilateral EFGH in FIG. 4, then precipitation harden again.

In its broader aspects, a T6 condition may be obtained by Precipitation hardening solution heat treated alloy at 175° to 325° F. Typical conditions may be:

a. For alloys containing less than 7.5% zinc, heating a solution heat treated article to 200° to 275° F. and holding for a period of 5 to 30 hours;

b. For alloys containing more than 7.5% zinc, heating a solution heat treated article to 175° to 275° F. and holding for a period of 3 to 30 hours.

A usual practice for obtaining the T6 condition is obtained by heating a specimen for 24 hours at 250° F. in a circulatory-air furnace.

According to another preferred embodiment of the invention, the alloy is solution heat treated, then precipitation hardened at a temperature of 175° to 325° F., then subjected to a time and temperature within the perimeter ABCD, more preferably EFGH, and then again precipitation hardened for a time of 2 to 30 hours at a temperature of 270° to 320° F.

The article of J. T. Staley et al. entitled "Heat Treating Characteristics of High Strength Al-Zn-Mg-Cu Alloys With and Without Silver Additions" appearing at pages 191 to 199 in the January 1972 issue of *Metallurgical Transactions*, published by ASM/AIME, shows that solution heat treat quench rate, the lapse of time between the solution heat treat quench and the beginning of heating for precipitation hardening, and the heating rate for precipitation hardening may affect the maximum yield strength obtainable in 7075 aluminum alloys. It is intended that, within the concepts of the present invention, the teachings of Staley et al be used in the present invention for optimizing results. Thus, it may be advantageous for increasing strength to immerse specimens, which have had their solution heat treatment quench, for example, 1½ years ago, into molten Wood's metal according to the invention.

Figure 2:
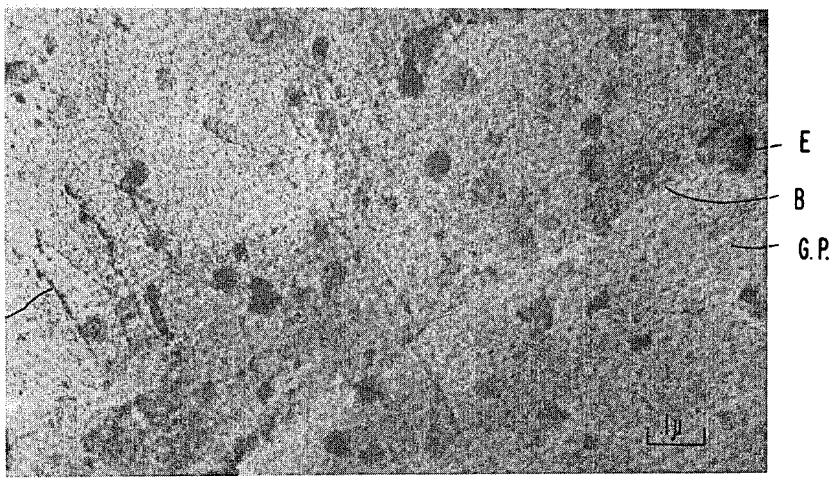
FIG. 2 (PRIOR ART)
Figure 3:
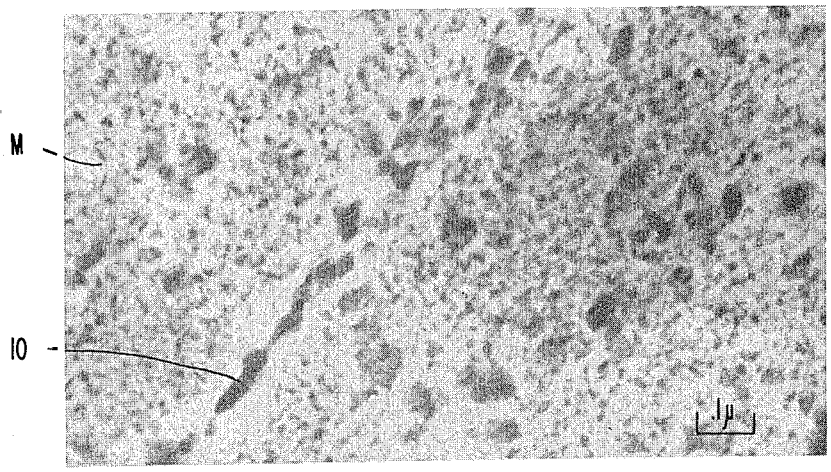
FIG. 3 (PRIOR ART)

Referring now to FIGS. 1 to 3, transmission electron micrographs of various microstructures important for consideration of the present invention are presented. All of FIGS. 1 to 3 were taken from a single ¼-inch thick 7075 aluminum alloy plate of composition A in Table I. FIGS. 1 to 3 are microstructures of prior art conditions of 7075 aluminum. In FIG. 1, an example of the W51 solution heat treated condition is given. A W51 solution heat treated microstructure is obtained in 7075 aluminum alloy plate by heating to 900° F. and then quenching in water at room temperature. The plate material is then stretched to from 1½ to 3% permanent set for stress relief. This gives the microstructure shown in FIG. 1, including E-phase particles of Al-Mg-Cr precipitate, matrix regions R of single phase aluminum solid-solution material, grain boundaries B and dislocations D. The mottling effect appearing in the matrix region of FIG. 1 is an artifact of the action of the thinning solution used in preparing thinned material for transition electron microscopy.

TABLE I

| Composition of Alloys, in Weight % | | |
|---|---|---|
| | Alloy | |
| Element | A | B |
| Cu | 1.45 | 1.63 |
| Fe | 0.19 | 0.30 |
| Si | 0.09 | 0.12 |
| Mn | 0.02 | 0.07 |
| Mg | 2.40 | 2.48 |
| Zn | 5.92 | 5.68 |
| Ni | 0.00 | 0.00 |
| Cr | 0.18 | 0.19 |
| Ti | 0.02 | 0.05 |
| Be | 0.001 | 0.001 |

FIG. 2 shows the 7075 alloy material of FIG. 1 after it has been brought to the T6, in particular the T651, temper by heating W51 material in a circulatory-air furnace for 24 hours at 250° F. E-phase remains substantially unchanged. Dislocations D and a grain boundary B are shown. Now in the matrix there has appeared many small black dots; these are referred to as G.P. zones and are clusterings of magnesium and zinc atoms generally in the ratio two zinc atoms for each magnesium atom.

FIG. 3 shows a specimen taken from the same plate of FIGS. 1 and 2 in the T73 condition, which is produced from W51 material by heating in circulatory-air furnaces for, first, 24 hours at 250° F. and, second, 8 hours at 350° F. Grain boundary precipitate 10 has appeared, and the G.P. zones have grown to greater size. The G.P. zones have begun to exhibit crystallinity by giving rise to X-ray diffraction patterns and are referred to by those in the art as M' and M-phase. Solution potential studies indicate that the M' and M-phases contain some copper atoms. It is believed that the G.P. zones progress toward crystallinity by becoming first M'-phase, which is still partially coherent with the matrix crystal structure. The M'-phase then changes to M phase, which has a crystal structure different from the matrix. It is believed also that the progression through the M'-phase to the M-phase makes the original G.P. zones increasingly anodic with respect to the matrix and that the resulting anodic particulate matter in the matrix protects against stress-corrosion cracking.

Further illustrative of the present invention are the following examples.

EXAMPLES 1 to 8

For each example, two tensile blanks of dimensions ⅜ inch by ⅜ inch by 2½ inches were cut from a single lot of 2½ inch thick 7075-T651 (metallurgical history as described for FIG. 2) alloy plate such that their lengths were in the short-transverse direction, i.e., in the direction perpendicular to the surface of the plate.

TABLE II

| Times and Temperatures in Wood's Metal for Examples 1 to 8 and the Coordinates of Points A to H. | | |
|---|---|---|
| Example No., or Point | Time, min. | Temperature °F. |
| 1 | 0.5 | 475 |
| 2 | 1.0 | 475 |
| 3 | 1.5 | 445 |
| 4 | 4.0 | 445 |
| 5 | 7.0 | 400 |
| 6 | 15.0 | 400 |
| 7 | 7.0 | 375 |
| 8 | 15.0 | 375 |
| A | 20.0 | 360 |
| B | 0.2 | 500 |
| C | 1.0 | 500 |
| D | 150.0 | 360 |
| E | 20.0 | 380 |
| F | 0.8 | 480 |
| G | 1.2 | 480 |
| H | 40.0 | 380 |

The chemical composition of the alloy is as presented for alloy B in Table I. The tensile blanks for each example were immersed in molten Wood's metal of composition 50% bismuth, 25% lead, 12.5% tin and 12.5% cadmium. The immersion temperatures and times are presented in tabular form in Table II and are plotted in FIG. 4. Following immersion in the molten Wood's metal, the cooled specimens were then precipitation hardened by heating them in a circulatory-air furnace for a time of 24 hours at 250° F. In each of Examples 1 to 8, a tensile blank was machined to a 0.125 inch diameter tensile bar for exposure to 3½% sodium chloride solution by alternate immersion at a stress level of 42 ksi according to Military Specification MIL-A-22771B. The specimens were held until failure with successive immersion for 10 minutes in the salt solution followed by 50 minutes in air. The number of days until failure under such treatment is provided in FIG. 4 above the time-temperature point for each example. The remaining blank of each example was tested for yield strength. The yield strength data for Examples 1 to 8 are presented in FIG. 4, below the time-temperature points, in terms of percentage of a yield strength of 62.3 ksi for the T651 condition.

Further illustrative of the preferred embodiment of the invention wherein the second precipitation-hardening step is carried out for 2 to 30 hours at a temperature of 270° and 320° F. are the following examples:

EXAMPLES 9 to 14

Procedure was described for Examples 1 to 8, except that all examples utilized an immersion in molten Wood's metal for 90 seconds at 445° F., before the second precipitation hardening. Other parameters and results were as presented in Table III Examples 9 to 11 form one group of comparative examples characterized by 3 hours at temperature in the second precipitation-hardening step, with Examples 12 to 14 forming a second group characterized by 24 hours at temperature in the second precipitation-hardening step. The superior strength and corrosion resistance obtained when the second precipitation-hardening was done for 2 to 30 hours at 270° to 320° F. will be apparent from comparison of the examples within the groups.

TABLE III

Parameters and Data for Examples 9 to 14, Involving Immersing Aluminum Alloy 7075-T651 in Molten Wood's Metal for 90 seconds At 445° F., Followed by a Second Precipitation Hardening Step

| Example No. | Time (Hours) & Temperature (°F.) of Second Precipitation Hardening | Tensile Strength, ksi | Yield Strength, ksi | Days to Fail 42 ksi load level | Days to Fail 35 ksi load level |
|---|---|---|---|---|---|
| 9 | 3 hrs./250° F. | 67.2 | 58.5 | 27 | 74 |
| 10 | 3 hrs./275° F. | 68.8 | 58.8 | 43 | 62 |
| 11 | 3 hrs./300° F. | 66.8 | 58.1 | 60 | 84 |
| 12 | 24 hrs./250° F. | 70.5 | 62.9 | 49 | 50 |
| 13 | 24 hrs./275° F. | 69.5 | 61.0 | 47 | 61 |
| 14 | 24 hrs./300° F. | 69.6 | 61.4 | 56 | 63 |

The following definitions hold herein:

a. The term "ksi" is equivalent to kilipounds per square inch.

b. Wherever percentages are given, reference is to % by weight, unless indicated otherwise.

c. The initials "G.P." stand for Guinier-Preston.

d. The term "minimum strength" means the level of strength at which 99% of the alloy product is expected to conform with a confidence level of 0.95 using standard statistical methods.

e. The term "ingot-derived" means solidified from liquid metal by a known or subsequently developed casting process rather than through powder metallurgy techniques. This term shall expressly include, but not be limited to, direct chill casting, electromagnetic continuous casting and any variations thereof.

f. In stating a numerical range for an element of a composition or a temperature or any other matter herein, and apart from and in addition to the customary rules for rounding off numbers, such is intended to specifically designate and disclose each number, including each fraction and/or decimal, between the stated minimum and maximum for said range. (For example 6 to 8 discloses 6.1, 6.2, . . . 6.9, 7, 7.1, 7.2, . . . and so on, up to 8. Similarly, 370 to 390 discloses 371, 372, . . . and so on, up to 390.)

The invention has been described to this point with specific reference to alloys containing 4% to 8% zinc, 1.5% to 3.5% magnesium and 1% to 2.5% copper. The invention is considered especially useful for alloys containing higher amounts of zinc such as 6% or 8% to 16% zinc, for instance 8% to 12% zinc. Alloys containing high amounts of zinc are known to exhibit high strength, but these alloys were previously considered of limited usefulness: because of corrosion problems such as exfoliation and stress corrosion cracking. The practice of the invention enables making new products of high zinc aluminum alloys having very high minimum yield strengths of at least about 83 or 85 ksi in sheet, plate or forgings, and for extruded products even higher minimum yield strength levels of about 90 si or more, in combination with good corrosion resistance.

The new products in accordance with the invention contain at least 6% zinc, preferably 8% or more zinc in order to achieve the desired high strength. Alloys containing at least 7 or 7.5% zinc are considered useful as are zinc contents of 9 or 10%. The zinc content for the improved products may be as high as 16% or possibly higher, for instance 18 or 20%. A maximum zinc of about 12% is preferred in some embodiments although maximum zinc levels up to as much as 13 or 14 or even 15% may be applied in the practice of this invention. Suitable ranges for zinc include: from about 7.5 or 8% or more up to about 9 or 9.5%; from about 8.5 or 9% up to about 10 or 10.5%, or even 11%; and from about 9.5 or 10% up to about 11.5 or 12%.

The improved aluminum alloy products contain magnesium in minimum amounts of about 1.5% although a minimum of at least 1.75 or 2% is preferred in some embodiments. The maximum amount for magnesium is about 4 or 4.25%, or possibly even 4.5% magnesium. Suitable ranges for magnesium include: from about 1.5% to about 2.5 or 3%; from about 1.7 or 2% up to about 3 or 3.5%; and from about 2% up to about 4 or 4.5%. Copper is present in an amount of at least 1 or 1.5% with the maximum copper being about 2.5 or 2.75%, or in some cases about 3%. Suitable ranges for copper include: from about 1% to about 2%; from about 1.3 or 1.5% up to about 2.5 or 2.7%, or even 3%; and from about 1% to about 2.5 or 3%. One preferred range for copper is about 1.75 or 2% to 2.5 or 2.75%. One range of alloys considered useful in practicing this invention contains from about 8% to about 11 or 11.5% zinc, from about 2% to about 3% magnesium and from about 1.75% to about 2.5% copper. The shaded area S of FIG. 6 sets out one preferred range of zinc and magnesium in accordance with the present invention for an alloy containing about 1.5 to 2.5% copper.

In practicing the invention, it is preferred, especially from the standpoint of toughness and fatigue properties, that the amount of zinc, magnesium and copper not exceed a dissolvable amount, by which is meant an amount that can be brought into solid solution during solution heat treatment such that not more than one volume percent of undissolved intermetallic phases greater than about 1 micron containing Zn, Cu and/or Mg are present after solution heat treating. Preferably, not over one-half volume percent of said intermetallic phases remains. Accordingly, it can be advantageous to limit the combined total of zinc, magnesium and copper to levels not exceeding about 16 or 17%. A preferred minimum for zinc, magnesium and copper should be at least about 12% although total contents of about 11 or 10.5% may also be sufficient. In some embodiments, the amount of copper present exceeds the amount of magnesium present, while in other embodiments, copper is less than or equal to the magnesium amount.

The improved alloy product should contain one or more ancillary elements selected from: up to about 0.2% zirconium, for instance about 0.03 to about 0.15% zirconium; up to about 0.25% chromium, for instance about 0.03 to about 0.2% chromium; up to about 0.2% vanadium, for instance about 0.03 to about 0.15% vanadium; up to about 0.5% hafnium, for instance about 0.03 to 0.4% hafnium; and/or up to about 0.4 or 0.5% manganese, for instance about 0.03 to about 0.35% manganese, although manganese levels up to about 0.8% or possibly 1% or 1.1 or 1.2% may impart further benefit to the improved alloy products. Preferably, the cumulative total for such elements should not exceed about 0.7 or 0.8%, or even about 1%. Where manganese is present above 0.5 or 0.6%, this total level might be as high as 1.3 or 1.4% or possibly even more. In any event, the total quantity of ancillary elements should not exceed an amount which can be maintained in supersaturated solid solution upon solidification of the molten alloy. These ancillary elements are considered to enhance the desired properties in the improved alloy products of the invention by suppressing recrystallization in products hot worked prior to solution heat treating and, in the case of recrystallized products such as some products cold worked by a substantial extent prior to solution heat treatment, controlling recrystallized grain size to fine grain sizes.

It is preferred that the iron and silicon content in the present products be less than about 0.05% each. Impurity levels of up to about 0.1% or more iron and up to about 0.1% or more silicon may also be acceptable but typically on a less preferred basis. On a still less preferred basis, the alloy can contain iron up to about 0.5% and silicon up to about 0.4%.

Some alloys considered suitable in accordance with the invention include those set forth in the following table:

TABLE IV

| | Examples of Alloy | | | | |
|---|---|---|---|---|---|
| Alloy No. | Zn | Mg | Cu | Zr | Mn |
| 1 | 6–8 | 1–2.5 | 1–2.5 | .04–.15 | — |
| 2 | 7.5–9 | 2–3 | 1.5–2.5 | .04–.15 | — |
| 3 | 8–9.5 | 2–3 | 1.5–2.5 | .04–.15 | — |
| 4 | 7.5–9 | 2.2–3.4 | 1.2–2.2 | .04–.15 | — |
| 5 | 8.5–10 | 2.1–3.2 | 1.2–2.2 | .04–.15 | — |
| 6 | 8–10 | 1.5–2.5 | 2–3 | .04–.15 | — |
| 7 | 8–11 | 2–3 | 1.5–2.5 | .04–.15 | — |
| 8 | 9–11.5 | 2–3 | 1.5–2.75 | .04–.15 | — |
| 9 | 9–11 | 2–3 | 1.7–2.6 | .04–.15 | — |
| 10 | 10–11.5 | 2–3 | 1.7–2.6 | .04–.15 | — |
| 11 | 8.5–10 | 1.5–2.5 | 1–2 | — | .5–.8 |
| 12 | 10.5–12 | 1.8–2.8 | 1–2 | — | .5–.8 |
| 13 | 9–11.5 | 1.7–2.6 | 1–2 | .04–.15 | .3–.8 |

Products in accordance with this invention may be formed various techniques for producing aluminum alloy products such as rolling, forging, extruding or any other metal working operations. Accordingly, the alloy products produced may include sheet, plate, extrusions, forgings or rods, bars or any other shapes. In some embodiments, it is preferred to have products including thicknesses from about 0.3 or 0.35 inch to about 1.5 or 2 inches, although the invention is considered suitable for producing products having or including other thicknesses in sections thereof.

The improved alloy products are produced by providing an ingot or other suitable working stock from the herein described alloy compositions and working said stock into the desired product, shape or configuration. Prior to working, the working stock can be homogenized by heating to a suitable high temperature, typically between about 860° and 920° F. Alternatively, the alloy may be cast into final shape although wrought or worked products are preferred. After desired working or shaping, the alloy may be solution heat treated by heating to one or more elevated temperatures from about 840° or 850° F. to about 880° or 900° F., or at still higher or lower temperatures depending on alloy composition, lower temperatures being favored with higher zinc content to avoid melting. The solution heat treatment is carried out to take into solid solution substantial portions or preferably substantially all of the zinc, magnesium and copper, it being recognized that physical processes are often not perfect such that every last vestige of these alloying ingredients may not be dissolved. Nonetheless, it is preferred where toughness and fatigue properties are concerned that not more than about one volume percent, preferably 0.5 vol. % or less, of undissolved intermetallic phases over one micron in size containing Zn, Cu and/or Mg remain in the alloy product after solutionizing.

After the aforesaid heating, the alloy is rapidly cooled or quenched by immersion or other suitable treatment in a quenching medium. This usually includes immersing in water, although water sprays or even air chilling may be useful in this respect. After quenching and prior to precipitation hardening, the alloy may be cold worked such as by stretching to relieve internal stresses. The solution heat treated and quenched alloy, with or without cold working, is then considered to be in a precipitation-hardenable condition. It is to be understood that solution heat treating or solutionizing as used herein includes quenching to a suitable lower temperature or a substitute or equivalent therefor so as to render the alloy suited to subsequent treatments described herein.

The precipitation-hardenable alloy is then treated in three steps, phases or treatments, although there may not be clear lines of demarcation between steps or phases. That is, it is known that ramping up to a particular aging temperature and ramping down therefrom are in themselves precipitation treatments which can, and often need to be, taken into account by integrating them, and their precipitation-hardening effects, into the treatment. This effect is described in U.S. Pat. No. 3,645,804, which is incorporated herein by reference. Thus while the three phases of aging according to this invention ca be effected in a single furnace operation, properly programmed, they are described herein for purposes of convenience as three phases or treatments. In accordance with the invention, the first phase or treatment precipitation hardens the alloy. Then the second phase treats the alloy at an elevated temperature to increase resistance to exfoliation and stress corrosion cracking (SCC). Then the third phase precipitation hardens the alloy to a high strength level.

In the first phase, the alloy is precipitation hardened to strengthen it to a point at or near peak strength, preferably less than peak strength (underaged strength), or, on a less preferred basis, at peak or slightly overaged strength. This can be effected by treating at one or more temperatures between room temperature and about 330° F., preferably between about 175° and 325° F. This treatment typically can extend a significant period of time, typically between about 2 to 30 or more hours and can occur through a temperature ramp-up to an elevated temperature for the second treatment phase. This precipitation hardening should strengthen the alloy product substantially over the strength achieved immediately after quenching (herein referred to as the as-quenched strength or solution treated strength) by at least 30% of the difference between as-quenched strength and peak yield strength, preferably to about 40% or 50% or more, for instance 60% or 70% or more of the difference between the as-quenched strength, or solution treated strength, and peak strength (the solution-peak strength differential) for the alloy product. Putting it another way, the precipitation-hardening of the alloy entering the second phase or treatment should have carried (increased) the product's strength by at least 30% (preferably more) of the way from as-quenched or solution treated strength (low strength) toward the peak strength.

The first phase can extend until the strength reaches up to about 95% of peak strength or reaches peak strength or even run past peak strength (overaged) back down to 95% of peak strength. However, it can be advantageous in some embodiments to limit the precipitation-hardening in the first phase to an underaged condition not exceeding 95% of peak yield strength. In a preferred embodiment, the alloy contains about 1.7% or more copper and the alloy enters the second phase at a strength increased above solution treated strength by about 70% to about 90% of the strength differential referred to in the immediately preceding paragraph. It is worth noting that alloys containing this copper level can increase in strength during the second treatment phase.

Figure 5:
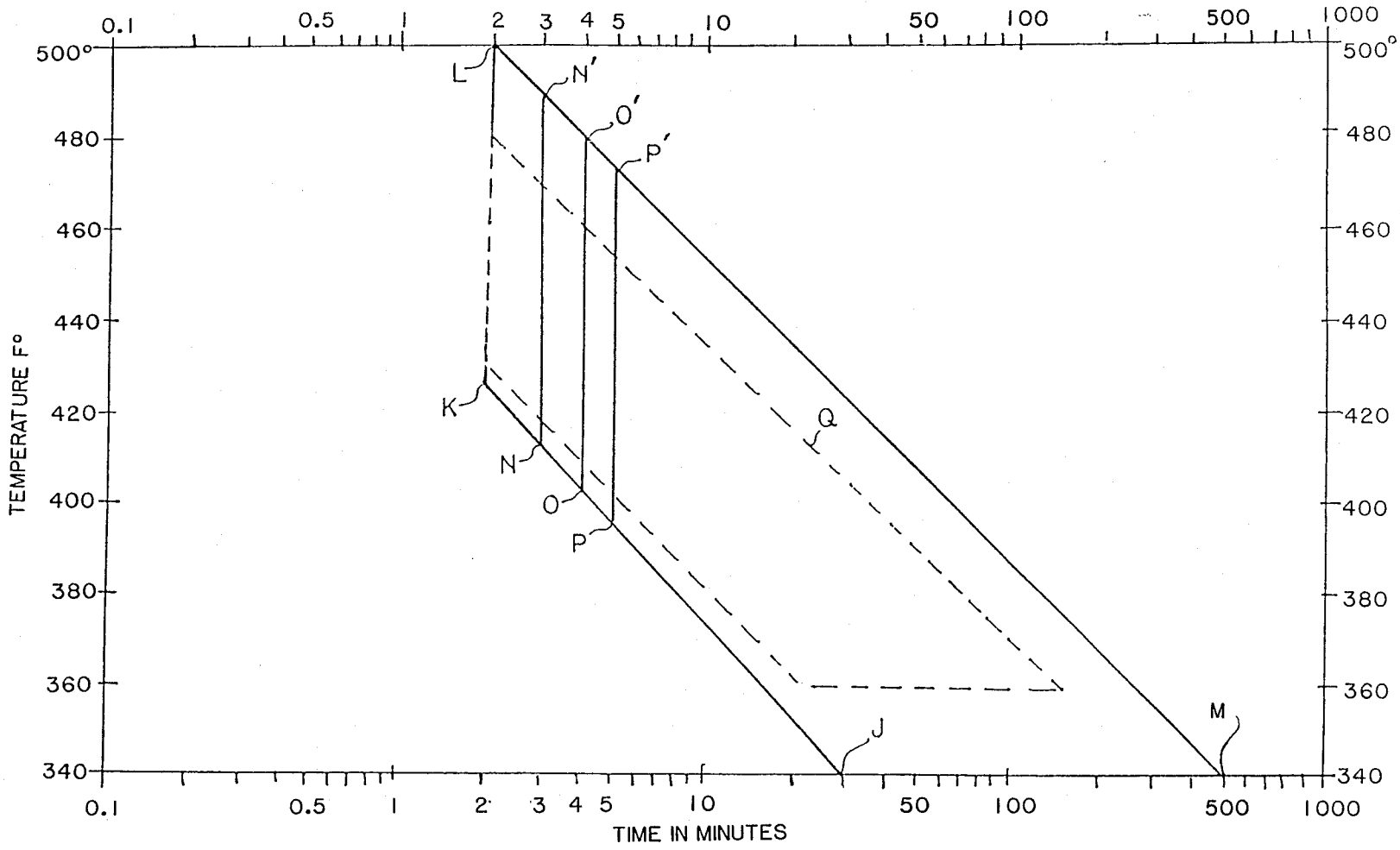
FIG. 5 is a graph showing characteristics of another embodiment for other 7000 Series aluminum alloy products.

The alloy in the condition just described is then subjected to the second phase or treatment at one or more temperatures above about 340° F. or 350° F., preferably at one or more temperatures within the range of about 360° F. to about 500° F., preferably for more than a few minutes. In general, temperatures of 360° F. or higher are preferred but as the zinc content increases, for instance above 9% or 10% or so, lower temperatures such as 350° F. or 340° F. or even possibly less become more useful than for lower zinc contents. The temperatures employed in the second phase normally exceed those in the first and third phases. In some preferred embodiments, the second treatment phase proceeds by subjecting the alloy to treatment within the perimeter ABCD of FIG. 4 or within the perimeter JKLM of FIG. 5, said treatment producing a cumulative time and temperature effect corresponding to a point within the aforesaid perimeter even though more than one temperature may be utilized during this phase. For instance, the effects of this treatment for a particular alloy can commence at a temperature of about 345° or 350° F. and continue as the temperatures are further increased such that "ramping up" and, or "ramping down" of temperatures between about 345°, 350° or 355° F. and higher temperatures within the aforesaid perimeter can be taken into account and integrated into determining the equivalent aging effect within the aforesaid perimeters ABCD and JKLM. This treatment may proceed for 3 or more minutes at one or more temperatures between about 360° and 490° F.; for 4 or more minutes at one or more temperatures between about 360° and 480° F.; or for 5 or more minutes at one or more temperatures between about 360° and 475° F. The 3, 4, and 5-minute marks of FIG. 5 are shown by lines N-N', O-O' and P-P', respectively. The area of overlap between FIGS. 4 and 5 is shown by dotted perimeter Q in FIG. 5. When referring to heating to one or more temperatures for a time of "x" minutes, such embraces heating to any number of temperatures in the designated range but for a cumulative time of "x" above the lowest temperature in the range. For instance, heating for 5 or more minutes at one or more temperatures from about 360° to 475° F. does not require holding for 5 minutes at each of several temperatures in said range, but rather, that the cumulative time at all temperatures between 360° and 475° F. is 5 minutes or more.

The second treatment phase increases resistance to stress corrosion cracking (S.C.C.), exfoliation and other corrosion effects. Generally speaking, better properties of S.C.C. resistance are achieved when proceeding at times and temperatures closer to line C-D of FIG. 4 and line L-M of FIG. 5, and better strength with good exfoliation resistance are achieved when proceeding in that area closer to lines A-B (FIG. 4) and J-K (FIG. 5). The second phase or treatment can be carried out by immersion in hot liquid such as molten salt, hot oil or molten metal. A furnace (hot air and/or other gases) may also be used. One advantageous practice utilizes a fluidized bed for the second treatment. Suitable media for the fluidized bed include alumina particles of about 50 or 60 mesh. The fluid bed heating media can provide fairly rapid heating (faster than a hot air furnace but slower than molten salt) and uniform heating of large or complex parts while presenting easier clean-up and environmental aspects than some other approaches. Induction heaters may also be used in the practice of the invention.

As indicated elsewhere herein, heating operations can be ramped-up fairly slowly such that much or even all of the treatments, especially the precipitation-hardening treatments of the first and/or third phases, can be accomplished by or during ramping-up to and/or -down from the elevated second phase temperature or temperatures such that there may not be discrete disruptions o interruptions between phases. However, the second phase can be considered to start when the corrosion properties start to improve. This typically involves some time at temperatures of about 360° or so or more after achieving the strengthening (precipitation-hardening) described in the first phase as mentioned hereinbefore. In some embodiments, the second phase can be considered accomplished when the desired degree of corrosion resistance is achieved and the temperature is suitably lowered for third phase precipitation-hardening. However, in some cases, the corrosion resistance can improve in the third phase such that the second phase can be shortened to a level less than the desired corrosion resistance to allow for this effect.

The alloy is then precipitation hardened in the third treatment or phase typically at one or more temperatures between room temperature and about 330° F., typically from about 175° to 325° F. This precipitation-hardening step may proceed at substantially the same temperature or temperatures employed in the earlier precipitation-hardening operation. The times employed ar about 2 to 30 or more hours. It is quite desirable in this third phase to utilize substantial exposures, typically for several hours, at one or more temperatures substantially below the higher (or highest) temperatures used in the second phase. During this precipitation-hardening phase, the strength of the product is increased to a very high level, above that accompanying the improved corrosion resistance achieved in the second phase and typically to the desired final yield strength level.

As can be seen from the foregoing, either or both precipitation-hardening phases and/or the intermediate higher temperature treatment can be performed at one or more temperatures by ramping up and/or down within a particular temperature range. As is generally recognized in the art, integration of aging effects under ramp-up or ramp-down conditions is useful in determining the total aging effect as described in U.S. Pat. No. 3,645,804, the disclosure of which is incorporated herein by reference.

It is preferred that the second phase treatment not be carried for time-temperature combinations excessively exceeding the extent needed to develop the desired level of corrosion resistance properties. Use of excessive time-temperature exposure in the second phase can impede the ability of the third phase to achieve the desired high level of strength. Accordingly, preferred practices for some products can include treatments to the left of line C-D in FIG. 4, and even to the left of line G-H (and upward and downward extensions thereof). Also, it may be of advantage in some cases to rapidly cool the product after a desired amount of treatment. Such cooling can be relatively drastic, such as by water quenching (immersion or sprays), or less drastic, such as by removal from the furnace and air or forced air (fans) cooled. Some advantage to rapid cooling from the second treatment, or rapid heating at the commencement of the second phase, can arise in some cases because of improvement in control of time and temperature. Thus, while ramping-up to and/or down from a temperature (more or less gradual heat-up and cool-down) can be employed, especially if ramp-up and ramp-down effects are appropriately accounted for, nonetheless, it may be advantageous in some cases to utilize rapid heat-up and/or rapid cool-down in one or more treatment phases, for instance in the second phase.

The microstructure changes that are believed to occur through the treatment phases just discussed can be of interest in understanding the invention. In the first treatment phase there are a relatively large number of closely spaced small particles containing Mg and Zn formed. The strength rises quite substantially and the overall solution potential of the alloy drops measurably. The microstructure is similar to a T6 microstructure and includes G.P. zones and metastable eta prime ($\eta'$) precipitates in the grain interior, equilibrium eta ($\eta$) (MgZn2) precipitates at the grain boundaries, and zones normally adjacent to the grain boundaries where there is substantially no detectable precipitate (precipitate-free-zone-PFZ). The PFZ contains more Zn and Mg in solution than the matrix further away from the grain boundary. This makes the PF electrochemically different (anodic) relative to the matrix in the grain interior such that corrosion can occur preferentially in this PFZ. This gives rise to exfoliation and stress corrosion cracking (S.C.C.) along PFZ's, thereby resulting in reduced resistance to these corrosion effects.

In the second treatment phase, strength can increase or decrease depending on composition and/or the extent of strengthening in the first phase. Solution potential does increase and so does corrosion resistance. The improvement in corrosion resistance is attributed to reducing the electrochemical difference referred to just above by removing more copper from solution in the grain interior region than in the PFZ regions. This is considered to occur as follows. Some all $\eta'$ (normally copper-free) in the grain interior matrix transforms to copper-free $\eta$ ($MgZn_2$). Dissolved copper leaves solution and converts Cu-free $\eta$ to copper-bearing $\eta$ (Mg(Zn, Cu, Al)), in both the grain boundaries and the grain matrix interior although some copper may possibly otherwise leave solution. The depletion of dissolved copper is more extensive in the grain interior region than the PFZ region, thus reducing the electrochemical (anodic) differential previously referred to. This, in turn, improves corrosion resistance quite substantially.

In the third phase, more $\eta'$ precipitate forms and this improves strength quite significantly.

Thus, the strength-imparting precipitation that occurs in the first phase is accompanied by an anodic differential between the PFZ's immediately adjacent the grain boundaries and the matrix within the grains, which differential causes serious corrosion problems. This anodic differential and the resulting corrosion problems are substantially relieved in the second phase, and the alloy is further strengthened in the third phase.

The alloy products produced in accordance with the invention will exhibit very high levels of minimum or guaranteeable strength, at least about 5% greater than the similarly sized and shaped 7X50 alloy product in the T6 temper. Alloy products of the invention may have minimum yield strengths about 7 or 9%, and up to 12% or more greater than 7X50-T6 counterparts while not suffering from the serious disadvantages previously associated with high zinc alloys. The improved products of the invention will exhibit T7-type levels of resistance to stress corrosion cracking, exfoliation and other corrosion effects while substantially exceeding the minimum strength levels of 7150-T6 products exemplified in Table V below, it being remembered that 7150-T6 is considered a very high strength aluminum alloy in the aerospace industry.

TABLE V

Minimum Yield Strength Levels in Tension (ksi)

| Plate: 7150-T651 Thickness (in.) | Longitudinal (L) Strength | Long Transverse (LT) Strength |
|---|---|---|
| 0.500–0.749 | 78 | 77 |
| 0.750–1.000 | 78 | 78 |
| 1.001–1.500 | 78 | 77 |

| Extrusion: 7150-T651X Registered by Boeing Thickness (in.) | Longitudinal (L) Strength |
|---|---|
| 0.250–0.499 | 78 |
| 0.500–0.749 | 78 |
| 0.750–2.000 | 78 |
| Alcoa-modified 7150-T651 | |
| 0.250–0.499 | 82 |
| 0.500–0.749 | 83 |
| 0.750–2.000 | 84 |

Strength comparisons herein refer to minimum strength, by which is meant the strength level that normal statistical methods would show at 95% confidence that 99% of the samples would equal or exceed. This guaranteeable or design-useful strength is referred to rather than typical values which ar higher but not normally used for design purposes. When compared for typical strength, the improved products would show substantially the same levels of improvement (5% or 10% or more over 7X50-T6) as for minimum or guaranteeable values. Improved plate products of the invention will exhibit minimum yield strengths which meet o exceed about 83 ksi, for instance greater than about 85 ksi, 87 ksi or more. Minimum yield strength values of about 90 ksi or more may also be achieved for plate products made according to this invention without suffering unacceptable levels of stress corrosion cracking, exfoliation or other corrosion effects. For improved extruded alloy products of the invention, minimum yield strengths of at least about 87 ksi to 88.5 ksi are achievable depending upon final alloy composition and overall product thickness. It is further considered practical to achieve minimum yield strength levels of about 90 ksi, 93 ksi or 95 ksi or more for thicker extruded shapes at acceptable levels of corrosion resistance. Minimum yield strengths in the neighborhood of about 100 ksi or higher may also be achieved without sacrificing acceptable corrosion resistance.

The improved products can exhibit corrosion resistance properties which meet or exceed those of 7X50 alloy products in T7-type tempers, for instance the T76 condition. This means that the improved products will be capable of surviving 20 days or more of alternate immersion testing in a 3.5% NaCl solution without cracking while under a constant stress of about 25 ksi or more. The practice of the invention may provide certain alloy products having stress corrosion cracking resistance levels which will survive 20 or more days of alternate immersion testing at stresses of about 35 ksi or more without cracking (the T74 temper). The resulting alloy product will further possess exfoliation resistances which meet or exceed those of the T76 and, more preferably, the T74 conditions listed in Table VI.

In Table VI, commercial corrosion resistance performance standards for T73, T74 and T76 tempers are set forth. Any product designated T76 must be capable of passing the T76 tests, and so on. The SCC test is based on the stress level that the product can sustain in a 20-day SCC test conducted by alternate immersion in accordance with ASTM Standard G44-75, incorporated herein by reference. In this test, short transverse specimens 1/8 inch (3.2 mm) in diameter are stressed in constant strain fixtures. The test specimens are then alternately exposed to 10 minutes immersion in a 3.5% aqueous NaCl solution and a 50-minute drying cycle while under a constant stress value (ksi). The test is carried out for 20 days (less if the specimen fails in less than 20 days). The exfoliation test is the EXCO test, ASTM Standard G34-72, -79, incorporated herein by reference.

TABLE VI

| | Corrosion Resistance Standards | |
|---|---|---|
| Temper | SCC Test Stress (ksi) | Exfoliation Requirement EXCO Test |
| T73 | 42 | P - pitting; little or no exfoliation |
| T74 | 35 | EA - slight or superficial exfoliation |
| T76 | 25 | EB - Moderate - more exfoliation than EA but still acceptable |

As can be seen, T73 is the most corrosion resistant temper in Table VI, with T74 and T76 being progressively less resistant but progressively stronger. The T6 temper normally fails all of these tests and is not considered well suited where stress corrosion cracking is a concern or where exfoliation corrosion could present a problem. Alloy 7050 (U.S. Pat. No. 3,881,966) is often sold in T74 and T76 tempers, whereas substantially identical alloy 7150 is typically sold in T6-type tempers because of its higher strength.

The present invention will enable achieving a substantial increase in strength over 7150 and 7050 products at equivalent levels of corrosion resistance. The invention can produce strength levels as much as 5 or 7% and more, such as increases of 9 or 10%, or even 12% or more greater than 7X50-T6. Moreover, T76-type corrosion resistance, or better, combined with such strength increases over the high strength levels of 7150-T651 will also be achievable in practicing the invention. Such combinations of high strength together with T76 corrosion resistance are extremely valuable in aerospace and other high strength aluminum alloy applications.

Having described the presently preferred embodiments, it is to be understood that the invention may be otherwise embodied within the scope of the appended claims which are intended to embrace all equivalents and all embodiments within the spirit of the invention.

What is claimed is:

1. A method for producing an aluminum alloy product having improved combinations of strength and corrosion resistance properties, said method comprising:

(a) providing an alloy consisting essentially of about 6–16% zinc, about 1.5–4.5% magnesium, about 1–3% copper, one or more elements selected from zirconium, chromium, manganese, titanium, vanadium and hafnium, the total of said elements not exceeding about 1%, the balance aluminum and incidental elements and impurities;

(b) solution heat treating the alloy;

(c) precipitation hardening the alloy above room temperature to increase its strength to a level exceeding as-solution heat treated strength by at least about 30% of the difference between as-solution heat treated strength and peak strength;

(d) subjecting the alloy to treatment at one or more temperatures sufficient for improving the corrosion resistance properties of said alloy for a cumulative time at said temperatures of more than about three minutes; and (e) precipitation hardening the alloy above room temperature.

2. The method of claim 1 wherein the alloy contains about 7.5 to about 12% zinc.

3. The method of claim 2 wherein the alloy contains about 9 to about 11% zinc.

4. The method of claim 1 wherein the alloy contains about 2 to about 4% magnesium.

5. The method of claim 1 wherein the alloy contains about 1.5 to about 2.5% copper.

6. The method of claim 1 wherein the alloy contains about 0.3 to about 0.8% manganese.

7. The method of claim 1 wherein the alloy further contains up to about 0.1% impurities including iron and silicon.

8. The method of claim 1 wherein the alloy contains more magnesium than copper.

9. The method of claim 1 wherein the alloy contains more copper than magnesium.

10. The method of claim 1 wherein (c) includes heating the alloy to one or more temperatures below about 340° F.

11. The method of claim 10 wherein recitation (c) includes precipitation hardening the alloy at one or more temperatures between room temperature and about 330° F.

12. The method of claim 1 wherein recitations (c) and (e) include subjecting the alloy to one or more temperatures within about 175° to 325° F.

13. The method of claim 1 wherein recitation (d) includes subjecting the alloy to one or more temperatures within about 350° to 500° F.

14. The method of claim 1 wherein recitation (d) includes subjecting the alloy to treatment for a cumulative time-temperature effect substantially within ABCD of FIG. 4, said treatment extending for a cumulative time of four or more minutes at temperatures between about 360° and 480° F.

15. The method of claim 14 wherein more than one temperature is used in recitation (d).

16. The method of claim 1 wherein recitation (d) includes subjecting the alloy to one or more temperatures within about 360° to 475° F. for a cumulative time within 360° to 475° F. of about five or more minutes.

17. The method of claim 1 wherein recitation (d) includes subjecting the alloy to treatment for cumulative time temperature effect substantially within JKLM of FIG. 5.

18. The method according to claim 17 wherein more than one temperature is used in recitation (d).

19. The method of claim 1 is capable of producing an improved alloy product wherein the alloy product produced has at least about 5% greater yield strength than a similarly-sized 7X50-T6 alloy product and has corrosion resistance properties which meet or exceed those of a 7X50-T76 alloy product.

20. The method of claim 1 wherein the alloy product produced: (i) has about 7% or more greater yield strength than a similarly-sized 7X50-T6 alloy product; (ii) is capable of surviving at least about 20 days of alternate immersion testing in a 3.5% NaCl solution without cracking under a stress of about 25 ksi or more; and (iii) has an exfoliation resistance level of "EB" or better.

21. A method for improving the strength, toughness and corrosive resistance properties of a solution heat treated 7XXX aluminum alloy containing about 7 to about 12% zinc; about 1.5 to about 2.7% magnesium; about 1 to about 3% copper; the total zinc, magnesium and copper content not exceeding an amount which will cause more than one volume percent of undissolved intermetallic phases containing said elements to remain after solution heat treating, said alloy further containing one or more elements selected from: up to about 0.2% zirconium, up to about 0.25% chronium, up to about 0.8% manganese, up to about 0.2% vanadium and up to about 0.5% hafnium, said method comprising:

(a) precipitation hardening the alloy at one or more temperature above room temperature but below about 340° F.;

(b) subjecting the alloy to treatment at one or more temperatures above about 340° F. for a cumulative time at temperatures above 340° F. of more than three minutes; and (c) precipitation hardening the alloy at one or more temperatures above room temperature but below about 340.

22. The method of claim 21 wherein the alloy contains about 7.5 to about 11.5% zinc, about 1.7 to about 2.3% magnesium and about 1.2 to about 3% copper.

23. The method of claim 21 wherein the alloy further contains up to about 0.08% iron and up to about 0.08% silicon.

24. The method of claim 21 wherein recitations (a) and (c) include heating the alloy at one or more temperatures between about 175 ° and 325° F.

25. The method of claim 21 wherein recitation (b) includes heating the alloy at one or more temperatures from about 360° F. to about 500° F.

26. The method of claim 21 wherein recitation (b) includes heating the alloy for a time-temperature equivalence substantially within JKLM of FIG. 5.

27. A method for producing aluminum alloy product having a minimum yield strength at least about 5% greater than the minimum yield strength for a similarly-sized 7X50-T6 alloy product and having corrosion resistance properties which meet or exceed those of a 7X50-T6 alloy product, said method comprising:

(a) providing an alloy consisting essentially of about 7 to about 12% zinc, about 1.5 to about 2.7% magnesium, about 1 to about 3% copper, the total zinc, magnesium and copper content not exceeding an amount which will substantially enter into solid solution during solution heat treatment, said alloy further including one or more elements selected from: up to about 0.2% zirconium, up to about 0.25% chromium, up to about 0.8% manganese, up to about 0.2% vanadium and up to about 0.5% hafnium, the balance aluminum and incidental elements and impurities;

(b) working said alloy into wrought condition;

(c) solution heat treating the alloy;

(d) precipitation hardening the alloy for about 2 or more hours in a first elevated temperature range to increase its strength;

(e) subjecting the alloy to one or more temperatures within about 340° C. to 500° F. for a cumulative time at temperatures within 340° to 500° F. of four minutes or more to impact to said alloy time temperature equivalence substantially within the perimeter JKLM of FIG. 5; and (f) precipitation hardening the alloy in the first temperature range to further improve its strength, said method imparting to the alloy improved combinations of strength and corrosion resistance properties.

28. The method of claim 27 wherein the alloy contains about 0.3 to about 0.8% manganese.

29. The method of claim 27 wherein the alloy further contains up to about 0.1% impurities including iron and silicon.

30. The method of claim 27 wherein the first temperature range is between about 175° and 325° F.

31. An improved alloy product consisting essentially of about 7 to 12% zinc, about 1.5 to 2.7% magnesium, about 1 to 3% copper, one or more elements selected from zirconium, chromium, manganese, vanadium and hafnium, the total of said elements not exceeding about 1%, the balance aluminum and incidental elements and impurities, said alloy product having at least about 5% greater yield strength than a similarly-sized 7X50-T6 product and having corrosion resistance properties which meet or exceed those of a 7X50-T6 product.

32. The alloy product of claim 31 which contains about 7 to 9.5% zinc, about 1.5 to 2.5% magnesium, about 1.8 to 3% copper and about 0.05 to 0.2% zirconium.

33. The alloy product of claim 31 which contains about 9.5 to 1.5% zinc, about 1.5 to 2.5% magnesium, about 1 to 2% copper and about 0.05 to 0.2% zirconium.

34. The alloy product of claim 31 which contains about 8 to 10% zinc, about 1.5 to 2.5% magnesium, about 2 to 3% copper and about 0.05 to 0.2% zirconium.

35. The alloy product of claim 31 which contains about 10.5 to 12% zinc, about 1.8 to 2.8% magnesium, about 1 to 2% copper and about 0.05 to 0.2% zirconium.

36. The alloy product of claim 31 which contains about 0.3 to 0.8% manganese.

37. The alloy product of claim 31 which is plate having at least about 83 ksi yield strength.

38. The alloy plate product of claim 37 wherein the yield strength is about 85 ksi or more.

39. The alloy product of claim 31 which is an extrusion having at least about 87 ksi yield strength.

40. The alloy extrusion product of claim 39 the yield strength is about 90 ksi or more.

41. The alloy product of claim 31 which is capable of surviving at least about 20 days of alternate immersion testing in a 3.5% NaCl solution without cracking under a stress of about 25 ksi or more, said alloy product having an exfoliation resistance level of "EB" or better.

42. An ingot-derived alloy product which consists essentially of about 7 to 12% zinc, about 1.5 to 2.7% magnesium, about 1 to 3% copper, one or more elements selected for zirconium, chromium, manganese, vanadium and hafnium, the total of said elements not exceeding about 1%, the balance aluminum and incidental elements and impurities, said alloy product having at least about 83 ksi yield strength and having an exfoliation resistance level of "EB" or better and good toughness.

43. The alloy product of claim 42 which contains one or more of: 0.05 to 0.2% zirconium, 0.03 to 0.2% vanadium and 0.03 to 0.5% hafnium.

44. The alloy product of claim 42 which has at least about 7% greater yield strength than a similarly-sized 7X50-T6 alloy product.

45. The alloy product of claim 44 which has at least about 9% greater yield strength than the 7X50-T6 alloy product.

46. The alloy product of claim 42 which is capable of surviving at least about 20 days of alternate immersion testing in a 3.5% NaCl solution without cracking under a stress of about 25 ksi or more.

47. The alloy product of claim 42 which is capable of surviving at least about 20 days of alternate immersion testing in a 3.5% NaCl solution without cracking under a stress of about 35 ksi or more, said alloy product having an exfoliation resistance level of "EA" or better.

48. An aluminum alloy product characterized by improved strength, toughness and corrosion resistance properties, said alloy product comprising an alloy consisting essentially of about 7 to 12% zinc, about 1.5 to 2.7% magnesium, about 1 to 3% copper, the total weight of zinc, magnesium and copper not exceeding about 15%, one or more elements selected from: up to about 0.2% zirconium, up to about 0.25% chromium, up to about 0.8% manganese, up to about 0.2% vanadium and up to about 0.5% hafnium, the balance aluminum and incidental elements and impurities, said alloy product having been solution heat treated and:

(a) precipitation hardened at one or more elevated temperatures to increase its relative strength;

(b) subjected to treatment for four or more minutes at one or more temperatures sufficient to improve its corrosion resistance properties; and (c) precipitation hardened to raise its yield strength to a level at least about 5% greater than that for a similarly-sized 7X50-T6 alloy product.

49. The alloy product of claim 48 which is plate having about 83 ksi minimum yield strength and an exfoliation resistance level of "EB" or better.

50. The alloy plate product of claim 49 wherein the minimum yield strength is about 85 ksi or more.

51. The alloy product of claim 48 which is an extrusion having about 87 ksi minimum yield strength and an exfoliation resistance level of "EB" or better.

52. The alloy extrusion product of claim 51 wherein the minimum yield strength is about 90 ksi or more.

53. A method for thermally treating an alloy product consisting essentially of about 7 to 12% zinc, about 1.5 to 2.7% magnesium, about 1 to 3% copper and up to about 0.2% zirconium, the balance aluminum and incidental elements and impurities, said method including: (a) solution heat treating the alloy product; (b) precipitation hardening the alloy product in a first temperature range above room temperature and below about 330° F.; (c) subjecting the alloy product to treatment in a second temperature range above the first temperature range for greater than three minutes but not so long as to prevent imparting a substantial strength increase to the alloy product during subsequent treatment; and (d) precipitation hardening the alloy product in a third temperature range above room temperature and below the second temperature range.

54. The method as claimed in claim 53 wherein the first and third temperature ranges are between about 175°–325° F.

55. The method as claimed in claim 53 wherein recitation (c) extends for about five or more minutes and corresponds to time-temperature equivalence substantially within ABCD of FIG. 4.

56. The method as claimed in claim 53 wherein recitation (c) corresponds to time-temperature equivalence substantially within JKLM of FIG. 5.

57. A method for thermally treating a wrought aluminum alloy consisting essentially of about 7.5 to 11.5% zinc, about 1.5 to 2.5% magnesium, about 1.2 to 3% copper and up to about 0.2% zirconium, said method comprising: (a) providing the alloy in a precipitation-hardenable condition; (b) precipitation hardening the alloy including heating within about 175°–325° F.; (c) subjecting the alloy to treatment for more three minutes at one or more temperatures sufficient for improving its corrosion resistance properties, said treatment imparting a cumulative time-temperature equivalence substantially within JKLM of FIG. 5; and (d) precipitation hardening the alloy including heating within about 175°–325° F. to raise its relative strength.

58. The method as claimed in claim 57 wherein recitation (c) includes heating the alloy to one or more temperatures within about 360° to 500° F. for a cumulative time within 360° to 500° F. of about four minutes or more.

59. The method as claimed in claim 57 wherein recitation (c) includes heating the alloy to one or more temperatures within about 340° to 500° F. for a cumulative time within 340° to 500° F. of about four minutes or more.

60. A method for treating a 7XXX aluminum alloy containing about 7 to 12% zinc, about 1.5 to 2.7% magnesium, about 1 to 3% copper, up to about 0.2% zirconium, up to about 0.25% chromium, up to about 0.8% manganese, up to about 0.2% vanadium and up to about 0.5% hafnium, said method comprising:

(a) providing the alloy in a wrought precipitation-hardenable condition;

(b) subjecting the alloy to one or more precipitation-hardening temperatures above room temperature to effect some precipitation therein;

(c) treating the alloy for a cumulative time of about four or more minutes at one or more elevated temperatures sufficient to improve the corrosion resistance of said alloy, said treatment imparting to the alloy time- temperature equivalence substantially within ABCD of FIG. 4; and (d) subjecting the alloy to one or more precipitation-hardening temperatures above room temperature to improve the strength of said alloy.

61. The method according to claim 60 wherein either or both of recitations (b) and (d) include subjecting said alloy to one or more temperatures within about 175° and 325° F.

62. The method according to claim 60 wherein recitation (c) includes heating the alloy to one or more temperatures within 340° to 500° F. for a cumulative time within 340° to 500° F. of five minutes or more.

63. The method according to claim 60 wherein the alloy contains about 7 to 9.5% zinc, about 1.5 to 2.5% magnesium, about 1.8 to 3% copper and about 0.03 to 0.2% zirconium.

64. The method according to claim 60 wherein the alloy contains about 9.5 to 11.5% zinc, about 1.5 to 2.5% magnesium, about 1 to 2% copper and about 0.03 to 0.2% zirconium.

65. The method according to claim 60 wherein the alloy contains about 8 to 10% zinc, about 1.5 to 2.5% magnesium, about 2 to 3% copper and about 0.03 to 0.2% zirconium.

66. The method according to claim 60 wherein the alloy contains about 10.5 to 12% zinc, about 1.8 to 2.8% magnesium, about 1 to 2% copper and about 0.03 to 0.2% zirconium.

67. A method for treating a 7XXX aluminum alloy containing about 7 to 12% zinc, about 1.5 to 2.7% magnesium, about 1 to 3% copper, up to about 0.2% zirconium, up to about 0.25% chromium, up to about 0.8% manganese, up to about 0.2% vanadium and up to about 0.5% hafnium, said method comprising:

(a) providing the alloy in a precipitation-hardenable condition;

(b) subjecting the alloy to one or more precipitation-hardening temperatures above room temperature to effect some precipitation therein;

(c) subjecting the alloy to treatment at one or more temperatures sufficient to improve the corrosion resistance thereof;

(d) subjecting the alloy to one or more precipitation-hardening temperatures above room temperature to significantly increase the strength of said alloy;

(e) the cumulative time at temperatures sufficient to improve corrosion resistance in recitation (c) being about four minutes or more but not so long as to prevent imparting a strength increase to the alloy in recitation (d).

68. The method according to claim 67 either or both recitations (b) and (d) include subjecting said alloy to one or more temperatures within about 175° to 325° F.

69. The method according to claim 67 wherein recitation (c) produces time-temperature equivalence substantially within ABCD of FIG. 4.

70. The method according to claim 67 wherein the cumulative time in recitation (e) is from about 5 minutes to about two and one-half hours.

71. The method according to claim 67 wherein the alloy contains about 7 to 9.5% zinc, about 1.5 to 2.5% magnesium, about 1.8 to 3% copper and about 0.03 to 0.2% zirconium.

72. The method according to claim 67 wherein the alloy contains about 9.5 to 11.5% zinc, about 1.5 to 2.5% magnesium, about 1 to 2% copper and about 0.03 to 0.2% zirconium.

73. The method according to claim 67 wherein the alloy contains about 8 to 10% zinc, about 1.5 to 2.5% magnesium, about 2 to 3% copper and about 0.03 to 0.2% zirconium.

74. The method according to claim 67 wherein the alloy contains about 10.5 to 12% zinc, about 1.8 to 2.8% magnesium, about 1 to 2% copper and about 0.03 to 0.2% zirconium.

75. A method for treating a 7XXX aluminum alloy containing about 7 to 12% zinc, about 1.5 to 2.7% magnesium, about 1 to 3% copper, up to 0.2% zirconium, up to about 0.25% chromium, up to about 0.8% manganese, up to about 0.2% vanadium and up to about 0.5% hafnium, the balance aluminum and incidental elements and impurities, said method comprising:

(a) providing the alloy in a wrought precipitation-hardenable condition;

(b) subjecting the alloy to one or more temperatures within about 175° to 325° F. to effect some precipitation therein;

(c) subjecting the alloy to treatment at on or more temperatures within about 360° to 500° F.; and (d) subjecting the alloy to one or more temperatures within about 175° to 325° F. to increase the strength of said alloy;

(e) the cumulative time spent at temperatures within about 360° to 500° F. in recitation (c) being from about 4 minutes to about two-and-one-half hours but not so long as to prevent imparting a strength increase in said recitation (d).

76. The method according to claim 75 wherein recitation (c) imparts to the alloy time-temperature equivalence substantially within ABCD of FIG. 4.

77. The method according to claim 75 wherein the alloy contains about 7 to 9.5% zinc, about 1.5 to 2.5% magnesium, about 1.8 to 3% copper and about 0.03 to 0.2% zirconium.

78. The method according to claim 75 wherein the alloy contains about 9.5 to 11.5% zinc, about 1.5 to 2.5% magnesium, about 1 to 2% copper and about 0.03 to 0.2% zirconium.

79. The method according to claim 75 wherein the alloy contains about 8 to 10% zinc, about 1.5 to 2.5% magnesium, about 2 to 3% copper and about 0.03 to 0.2% zirconium.

80. The method according to claim 75 wherein the alloy contains about 10.5 to 12% zinc, about 1.8 to 2.8% magnesium, about 1 to 2% copper and about 0.03 to 0.2% zirconium.

81. A method for treating a 7XXX aluminum alloy containing about 7 to 12% zinc, about 1.5 to 2.7% magnesium, about 1 to 3% copper, up to about 0.25% chromium, up to about 0.8% manganese, up to about 0.2% vanadium and up to about 0.5% hafnium, said method comprising:

(a) providing said alloy in a wrought precipitation-hardenable condition;

(b) subjecting said alloy to one or more temperatures within about 175° to 325° F. to effect some precipitation therein;

(c) increasing the temperature of said a to one or more temperatures within about 360° to 500° F. for subjecting it to treatment for a cumulative time within about 360° to 500° F. from about 4 minutes to about two-and-one-half hours, said treatment corresponding to time-temperature equivalence substantially within ABCD of FIG. 4; and (d) subjecting said alloy to one or more temperatures within about 175° to 325° F. to improve its strength.

82. The method according to claim 81 wherein the alloy contains about 7 to 9.5% zinc, about 1.5 to 2.5% magnesium, about 1.8 to 3% copper and about 0.03 to 0.2% zirconium.

83. The method according to claim 81 wherein the alloy contains about 9.5 to 11.5% zinc, about 1.5 to 2.5% magnesium, about 1 to 2% copper and about 0.03 to 0.2% zirconium.

84. The method according to claim 81 wherein the alloy contains about 8 to 10% zinc, about 1.5 to 2.5% magnesium, about 2 to 3% copper and about 0.03 to 0.2% zirconium.

85. The method according to claim 81 wherein the alloy contains about 10.5 to 12% zinc, about 1.8 to 2.8% magnesium, about 1 to 2% copper and about 0.03 to 0.2% zirconium.

86. A method-for treating a 7XXX aluminum alloy containing about 7 to 12% zinc, about 1.5 to 2.7% magnesium, about 1 to 3% copper, up to about 0.2% zirconium, up to about 0.25% chromium, up to about 0.8% manganese, up to about 0.2% vanadium and up to about 0.5% hafnium, the balance aluminum and incidental elements and impurities, said method comprising:

(a) providing the alloy in a wrought precipitation-hardenable condition;

(b) subjecting the alloy to one or more temperatures within about 175° to 325° F. for a cumulative time within 175° to 325° F. of about two hours or more to impart some precipitation therein;

(c) subjecting the alloy to treatment within a range of about 340° to 500° F. for a cumulative time within said range from about 5 minutes to about two-and-one-half hours, said treatment corresponding to time-temperature equivalence substantially within ABCD of and (d) subjecting the alloy to one or more temperatures within about 175° to 325° F. for a cumulative time within 175° to 325° F. of about two hours or more to significantly increase its relative strength.

87. The method according to claim 86 wherein the alloy contains about 7 to 9.5% zinc, about 1.5 to 2.5% magnesium, about 1.8 to 3% copper and about 0.03 to 0.2% zirconium.

88. The method according to claim 86 wherein the alloy contains about 9.5 to 11.5% zinc, about 1.5 to 2.5% magnesium, about 1 to 2% copper and about 0.03 to 0.2% zirconium.

89. The method according to claim 86 wherein the alloy contains about 8 to 10% zinc, about 1.5 to 2.5% magnesium, about 2 to 3% copper and about 0.03 to 0.2% zirconium.

90. The method according to claim 86 wherein the alloy contains about 10.5 to 12% zinc, about 1.8 to 2.8% magnesium, about 1 to 2% copper and about 0.03 to 0.2% zirconium.

91. A method for treating a 7XXX aluminum alloy containing about 7 to 12% zinc, about 1.5 to 2.7% magnesium, about 1 to 3% copper and one or more elements selected from zirconium, chromium, manganese, vanadium and hafnium, the total of said elements not exceeding about 1%, comprising:

(a) providing the alloy in a solution heat treated condition;

(b) subjecting the alloy to one or more temperatures within about 175° to 325° F. for a substantial cumulative time within about 175° to 325° F.;

(c) subjecting the alloy to one or more temperatures within about 340° to 500° F. for a cumulative time within about 340° to 500° F. from about four minutes to about two and one-half hours; and (d) subjecting the alloy to one or more within about 175° to 325° F. for a cumulative time within about 175° to 325° F. sufficient to increase the strength of said alloy;

(e) said subjecting in recitation (c) being excessive to obtaining a strength increase in recitation (d).

92. The method according to claim 91 wherein said subjecting in recitation (c) imparts time-temperature equivalence substantially within ABCD of FIG. 4.

93. The method according to claim 91 wherein said subjecting in recitation (c) imparts time-temperature equivalence substantially within JKLM of FIG. 5.

94. The method according to claim 91 wherein the alloy contains about 7 to 9.5% zinc, about 1.5 to 2.5% magnesium, about 1.8 to 3% copper and about 0.03 to 0.2% zirconium.

95. The method according to claim 91 wherein the alloy contains about 9.5 to 11.5% zinc, about 1.5 to 2.5% magnesium, about 1 to 2% copper and about 0.03 to 0.2% zirconium.

96. The method according to claim 91 the alloy contains about 8 to 10% zinc, about 1.5 to 2.5% magnesium, about 2 to 3% copper and about 0.03 to 0.2% zirconium.

97. The method according to claim 91 wherein the alloy contains about 10.5 to 12% zinc, about 1.8 to 2.8% magnesium, about 1 to 2% copper and about 0.03 to 0.2% zirconium.

98. A method for treating a 7XXX aluminum alloy containing about 7 to 12% zinc, about 1.5 to 2.7% magnesium, about 1 to 3% copper, and up to about 1% of one or more elements selected from zirconium, chromium, manganese, vanadium and hafnium, said method comprising:

(a) providing the alloy in a solution heat treated condition;

(b) subjecting the alloy to one or more temperatures within about 175° to 325° F. for a cumulative time within about 175° to 325° F. of about three hours or more;

(c) subjecting the alloy to one or more temperatures within about 360° to 500° F. for a cumulative time within about 360° to 500° F. from about 4 minutes or more to about two and one-half hours for imparting to the alloy time-temperature equivalence substantially within ABCD of FIG. 4; and (d) subjecting the alloy to one or more temperatures within about 175° to 325° F. for a cumulative time within about 175° to 325° F. of about 2 hours or more.

99. The method according to claim 98 wherein the alloy contains about 7 to 9.5% zinc, about 1.5 to 2.5% magnesium, about 1.8 to 3% copper and about 0.03 to 0.2% zirconium.

100. The method according to claim 98 wherein the alloy contains about 9.5 to 11.5% zinc, about 1.5 to 2.5% magnesium, about 1 to 2% copper and about 0.03 to 0.2% zirconium.

101. The method according to claim 98 wherein the alloy contains about 8 to 10% zinc, about 1.5 to 2.5% magnesium, about 2 to 3% copper and about 0.03 to 0.2% zirconium.

102. The method according to claim 98 wherein the alloy contains about 10.5 to 12% zinc, about 1.8 to 2.8% magnesium, about 1 to 2% copper and about 0.03 to 0.2% zirconium.

103. A method for treating a 7XXX aluminum alloy containing about 7 to 12% zinc, about 1.5 to 2.7% magnesium, about 1 to 3% copper, and up to about 1% of one or more elements selected from zirconium, chromium, manganese, vanadium and hafnium, said method comprising:

(a) providing the alloy in a solution heat treated condition;

(b) subjecting the alloy to one or more temperatures within about 175° to 325° F. for a substantial cumulative time within about 175° to 325° F.;

(c) increasing the temperature of said alloy and subjecting it to one or more temperatures within about 340° to 500° F. for a cumulative time within 340° to 500° F. from about four minutes or more to about two and one-half hours; and (d) subjecting the alloy to one or more cumulative time within about 175° to 325° F.;

(e) said subjecting in recitation (c) not being excessive to imparting a significant strength increase to the alloy in recitation (d).

104. The method according to claim 103 wherein said substantial cumulative time within about 175° to 325° F. in recitation (b) is about 3 hours or more.

105. The method according to claim 103 wherein said cumulative time within about 175° to 325° F. in recitation (d) is about 2 hours or more.

106. The method according to claim 103 wherein said subjecting in recitation (c) imparts time-temperature equivalence substantially within ABCD of FIG. 4.

107. The method according to claim 103 wherein said subjecting in recitation (c) imparts time-temperature equivalence substantially within EFGH of FIG. 4.

108. The method according to claim 103 wherein said subjecting in recitation (c) imparts time-temperature equivalence substantially within JKLM of FIG. 5.

109. The method according to claim 103 wherein the alloy contains about 7 to 9.5% zinc, about 1.5 to 2.5% magnesium, about 1.8 to 3% copper and about 0.03 to 0.2% zirconium.

110. The method according to claim 103 wherein the alloy contains about 9.5 to 11.5% zinc, about 1.5 to 2.5% magnesium, about 1 to 2% copper and about 0.3 to 0.2% zirconium.

111. The method according to claim 103 wherein the alloy contains about 8 to 10% zinc, about 1.5 to 2.5% magnesium, about 2 to 3% copper and about 0.03 to 0.2% zirconium.

112. The method according to claim 103 wherein the alloy contains about 10.5 to 12% zinc, about 1.8 to 2.8% magnesium, about 1 to 2% copper and about 0.03 to 0.2% zirconium.

113. A method for treating a 7XXX alloy containing about7 to 12% zinc, about 1.5 to 2.7% magnesium, about 1 to 3% copper, up to about 1% of one or more elements selected from zirconium, chromium, manganese, vanadium and hafnium, the balance aluminum and incidental elements and impurities, said method comprising:

(a) providing the alloy in a wrought precipitation-hardenable condition;

(b) subjecting the alloy to one or more temperatures within about 175° to 325° F. for a cumulative time within about 175° to 325° F. of about 3 hours or more;

(c) increasing the temperature of said alloy and subjecting it to one or more temperatures within about 340° to 500° F. for a cumulative time within 340° to 500° F. from about 5 minutes to about two and one-half hours to impart to said alloy time-temperature equivalence substantially within JKLM of FIG. 5; and (d) subjecting the alloy to one or more temperatures within about 175° to 325° F. for a cumulative time within about 175° to 325° F. of about two hours or more.

114. The method according to claim 113 wherein the alloy contains about 7 to 9.5% zinc, about 1.5 to 2.5% magnesium, about 1.8 to 3% copper and about 0.03 to 0.2% zirconium.

115. The method according to claim 113 wherein the alloy contains about 9.5 to 11.5% zinc, about 1.5 to 2.5% magnesium, about 1 to 2% copper and about 0.03 to 0.2% zirconium.

116. The method according to claim 113 wherein the alloy contains about 8 to 10% zinc, about 1.5 to 2.5% magnesium, about 2 to 3% copper and about 0.03 to 0.2% zirconium.

117. The method according to claim 113 wherein the alloy contains about 10.5 to 12% zinc, about 1.8 to 2.8% magnesium, about 1 to 2% copper and about 0.03 to 0.2% zirconium.

118. A method for imparting improved combinations of strength, toughness and corrosion resistance to a solution-heat-treated alloy product consisting essentially of about 7 to 12% zinc, about 1.5 to 2.7% magnesium, about 1 to 3% copper, and up to about 1% of one or more elements selected from zirconium, chromium, manganese, vanadium and hafnium, the balance aluminum and incidental elements and impurities, said method comprising: (a) treating the alloy product at more than one elevated temperature to: (i) form hardening precipitates; and (ii) improve its corrosion resistance, said treatment including heating within about 360°–500° F. for greater than three minutes to impart a cumulative time-temperature effect substantially within JKLM of FIG. 5; and (b) precipitation hardening the alloy product including heating at one or more temperatures between about 175°–325° F. to increase its strength.

119. The method as claimed in claim 118 wherein recitation (a)(i) includes treating the alloy product for at least about two hours between about 175°°325° F. to form hardening precipitates before heating for said cumulative time-temperature effect.

120. The product produced by the method of claim 1.

121. The product produced by the method of claim 21.

122. The product produced by the method of claim 27.

123. The product produced by the method of claim 53.

124. The product produced by the method of claim 57.

125. The product produced by the method of claim 60.

126. The product produced by the method of claim 75.

127. The product produced by the method of claim 86.

128. The product produced by the method of claim 91.

129. The product produced by the method of claim 98.

130. The product produced by the method of claim 103.

131. The product produced by the method of claim 113.

132. The product produced by the method of claim 118.

133. The product produced by the method of claim 123.

* * * * *

UNITED STATES PATENT AND TRADEMARK OFFICE

CERTIFICATE OF CORRECTION

PATENT NO. : 4,863,528

DATED : Sep. 5, 1989

INVENTOR(S) : Melvin H. Brown, James T. Staley, John Liu, Sootae Lee and Roberto J. Rioja It is certified that error appears in the above-identified patent and that said Letters Patent is hereby corrected as shown below:

Delete entire contents of patent (including drawings) and substitute the attached.

Signed and Sealed this

Seventeenth Day of March, 1992

*Attest:*

HARRY F. MANBECK, JR.

*Attesting Officer*

*Commissioner of Patents and Trademarks*

United States Patent [19]

Brown et al.

[11] Patent Number: 4,863,528

[45] **Date of Patent: * Sep. 5, 1989**

[54] ALUMINUM ALLOY PRODUCT HAVING IMPROVED COMBINATIONS OF STRENGTH AND CORROSION RESISTANCE PROPERTIES AND METHOD FOR PRODUCING THE SAME

[75] Inventors: Melvin H. Brown, Morning Sun, Iowa; James T. Staley, Murrysville, Pa.; John Liu, Lower Burrell, Pa.; Sootae Lee, Export, Pa.; Roberto J. Rioja, Lower Burrell, Pa.

[73] Assignee: Aluminum Company of America, Pittsburgh, Pa.

[ * ] Notice: The portion of the term of this patent subsequent to Oct. 16, 2001 has been disclaimed.

[21] Appl. No.: 99,445

[22] Filed: Sep. 21, 1987

Related U.S. Application Data

[63] Continuation-in-part of Ser. No. 142,541, Apr. 21, 1980, abandoned, which is a continuation of Ser. No. 410,109, Oct. 26, 1973, abandoned.

[51] Int. Cl.[4] ..... C22F 1/04

[52] U.S. Cl. ..... 148/12.7 A; 148/159; 148/417; 148/418; 148/439

[58] Field of Search ..... 148/159, 2, 3, 11.5 A, 148/12.7 A, 415–418, 437–440

[56] References Cited

U.S. PATENT DOCUMENTS

| | | | |
|---|---|---|---|
| 1,924,729 | 8/1933 | Weber . | |
| 2,166,495 | 7/1939 | Igarashi et al. . | |
| 2,166,496 | 7/1939 | Igarashi et al. . | |
| 2,248,185 | 7/1941 | Nock | 148/21.1 |
| 2,376,681 | 5/1945 | Gauthier . | |
| 2,403,037 | 7/1946 | Zeigler et al. . | |
| 2,742,688 | 4/1956 | Nock, Jr. . | |
| 3,198,676 | 8/1965 | Sprowls et al. | 148/159 |
| 3,231,435 | 1/1966 | Rotsell et al. | 148/159 |
| 3,287,185 | 11/1966 | Vachet et al. | 148/159 |
| 3,305,410 | 2/1967 | Sublett et al. | 148/159 |
| 3,563,814 | 2/1971 | Lyle et al. | 148/12.7 |
| 3,645,804 | 2/1972 | Ponchel | 148/128 |
| 3,836,405 | 9/1974 | Staley et al. | 148/12.7 |
| 3,856,584 | 12/1974 | Cina | 148/159 |
| 3,881,966 | 5/1975 | Staley et al. | 148/12.7 |
| 3,945,861 | 3/1976 | Anderson et al. | 148/12.7 |
| 3,947,297 | 3/1976 | Reimann et al. | 148/159 |
| 4,063,936 | 12/1977 | Nagase et al. | 75/141 |
| 4,069,072 | 1/1978 | Develay et al. | 148/32 |
| 4,126,448 | 11/1978 | Moore et al. | 75/146 |
| 4,189,334 | 2/1980 | Dubost et al. | 148/159 |
| 4,193,822 | 3/1980 | Adam et al. | 148/3 |
| 4,200,476 | 4/1980 | Dubost et al. | 148/12.7 |
| 4,305,763 | 12/1981 | Quist et al. | 148/12.7 |
| 4,345,951 | 8/1982 | Coupry et al. | 148/2 |
| 4,431,467 | 2/1984 | Staley et al. | 148/159 |
| 4,477,292 | 10/1984 | Brown | 148/20 |
| 4,629,517 | 12/1986 | Lifka et al. | 148/12.7 |
| 4,732,610 | 3/1988 | Hildeman et al. | 420/532 |

FOREIGN PATENT DOCUMENTS

| | | |
|---|---|---|
| 1206354 | 6/1986 | Canada . |
| 58-061246 | 4/1983 | Japan . |
| 58-113342 | 7/1983 | Japan . |
| 60-013047 | 1/1985 | Japan . |
| 60-180637 | 9/1985 | Japan . |
| 61-238937 | 10/1986 | Japan . |
| 61-259828 | 11/1986 | Japan . |
| 62-063641 | 3/1987 | Japan . |
| 62-142753 | 6/1987 | Japan . |
| 473759 | 10/1975 | U.S.S.R. . |
| 1476942 | 6/1977 | United Kingdom . |
| 1480351 | 7/1977 | United Kingdom . |

OTHER PUBLICATIONS

"Precipitation Hardening and Stress Corrosion in $AlZnMg_3$", W. Gruhl et al., *Z. Metallkunde*, vol. 55, No. 10, pp. 577–582, (1964).

"Thermomechanical Treatments on High Strength Al—Zn—Mg(—Cu) Alloys", *Metallurgical Transactions*, vol. 4, pp. 1133–1144, (Apr. 1973).

"New Technique for Reducing Susceptibility to Stress–Corrosion of High Strength Aluminum Alloys", Published by the Pittsburgh Chapter of the American Society for Metals, (1974).

"A New Approach to the Problem of Stress Corrosion Cracking in 7075–T6 Aluminum", *Canadian Aeronautics and Space Journal*, vol. 27, No. 3, pp. 222–232, (1981).

"Microstructural Study of a High–Strength Stress–Corrosion Resistant 7075 Aluminum Alloy", *Journal of Materials Science*, vol. 17, pp. 2817–2824, (1982).
"Retrogression and Reaging Response of 7475 Aluminum Alloy", *Metals Technology*, vol. 10, pp. 386–392, (Oct. 1983).
J. T. Staley, Investigation to Improve the Stress–Corrosion Resistance of Aluminum Aircraft Alloys Through Alloy Additions and Specialized Heat Treatment, Under NAVAIR Contract N00019–68–C–0146, Oct. 1, 1972.

*Primary Examiner*—R. Dean
*Attorney, Agent, or Firm*—Carl R. Lippert; Daniel A. Sullivan, Jr.; Gary P. Topolosky

[57] ABSTRACT

There is disclosed a method for producing an aluminum alloy product and the resulting product having improved combinations of strength and corrosion resistance. The method includes providing an alloy consisting essentially of about 6–16% zinc, about 1.5–4.5% magnesium, about 1–3% copper, one or more elements selected from zirconium, chromium, manganese, titanium, vanadium and hafnium, the total of said elements not exceeding about 1%, the balance aluminum and incidental impurities. The alloy is then solution heat treated; precipitation hardened to increase its strength to a level exceeding the as-solution heat treated strength level by at least about 30% of the difference between as-solution heat treated strength and peak strength; subjected to treatment at a sufficient temperature or temperatures for improving its corrosion resistance properties; and again precipitation hardened to raise its yield strength and produce a high strength, highly corrosion resistant alloy product.

133 Claims, 6 Drawing Figures

ALUMINUM ALLOY PRODUCT HAVING IMPROVED COMBINATIONS OF STRENGTH AND CORROSION RESISTANCE PROPERTIES AND METHOD FOR PRODUCING THE SAME

CROSS-REFERENCE TO RELATED APPLICATIONS

This is a continuation-in-part of pending U.S. application Ser. No. 142,541, filed on Apr. 21, 1980, which is a continuation of U.S. application Ser. No. 410,109, now abandoned, the disclosures of which are fully incorporated herein by reference.

BACKGROUND OF THE INVENTION

The present invention relates to a method for thermally treating articles containing an alloy based on aluminum and to improved alloy products produced by this method.

The precipitation-hardened aluminum alloy 7075, and other 7XXX alloys, in the T6 temper have not given sufficient resistance to corrosion under certain service conditions. The T7-type tempers improve the resistance of these alloys to stress corrosion cracking, but decrease strength significantly vis-a-vis the T6 condition.

SUMMARY OF THE INVENTION

An object of the present invention is to provide a new heat treating method to produce an aluminum alloy in a unique heat treated condition for providing favorable resistance to corrosion combined with high strength.

Another object is to provide an aluminum-based alloy product having at least about 5% greater yield strength than a similarly sized 7X50 alloy product in the T6 condition in combination with corrosion resistance properties which meet or exceed those of 7X50 alloy in a T7-type temper, for instance the T76 condition.

These objects, as well as other objects which will become apparent in the discussion which follows, are achieved according to the present invention by the herein-described method of thermally treating an article composed of an alloy consisting essentially of aluminum, about 4 or 6 to 16% zinc, about 1.5 to 4.5% magnesium, about 1 to 3% copper, and one or more elements selected from the group consisting of up to about 0.2% zirconium, up to about 0.25% chromium, up to about 0.8% manganese, up to about 0.2% vanadium and up to about 0.5% hafnium. All composition percentages herein are by weight percent unless indicated otherwise. Improved products in accordance with the invention exhibit very high strength combined with good exfoliation corrosion and stress corrosion cracking resistance. The method includes the steps of solution heat treating the article, then precipitation hardening the article at 175° to 325° F., then subjecting the article to a time and temperature within the perimeter ABCD of FIG. 4 or JKLM of FIG. 5, and then again precipitation hardening at 175° to 325° F.

BRIEF DESCRIPTION OF THE DRAWING

FIGS. 1–3 are transmission electron micrographs of sections in a plate of aluminum alloy 7075. The distance equivalent to 0.1 micron is indicated on the micrographs. The metal surfaces reproduced in the micrographs all were perpendicular to the direction of rolling of the plate.

FIG. 1 shows a prior art solution heat treated and stress relieved condition referred to as the W51 condition.

FIG. 2 shows the prior art precipitation-hardened condition referred to as the T6 condition.

FIG. 3 shows the prior art stress corrosion cracking resistant condition referred to as the T73 condition.

FIG. 4 is a graph showing characteristics of the invention.

FIG. 5 is a graph showing characteristics of another embodiment for other 7000 Series aluminum alloy products.

Figure 6:
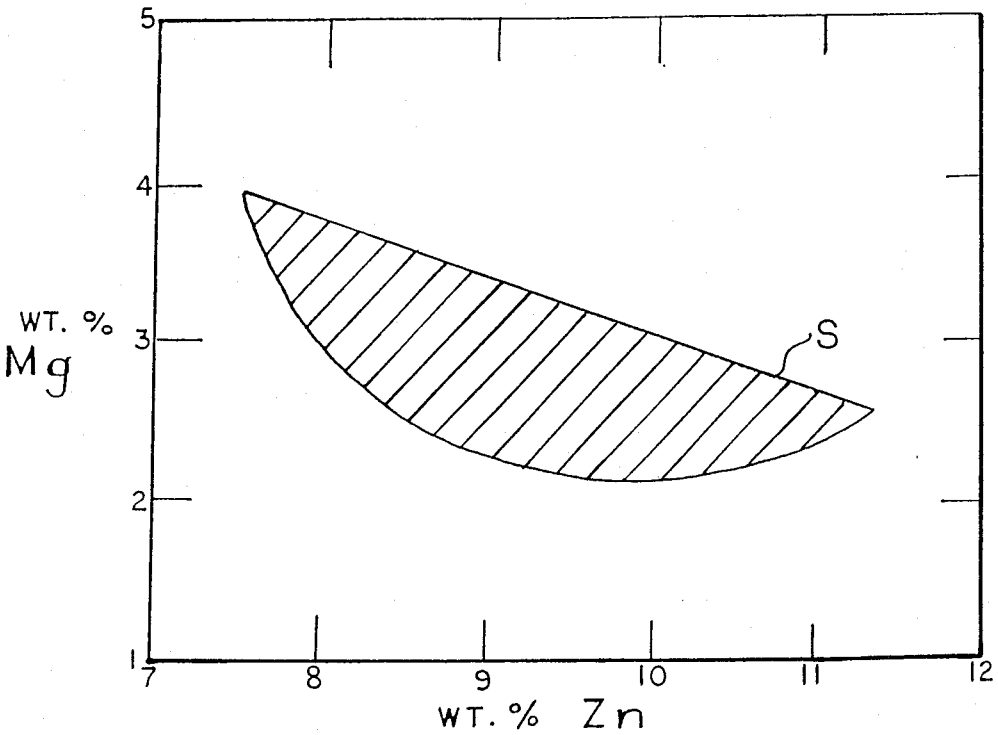
FIG. 6 is a graph showing preferred zinc and magnesium composition ranges for an improved aluminum alloy product containing about 1.5 to 2.5 wt. % copper.
Figure 1:
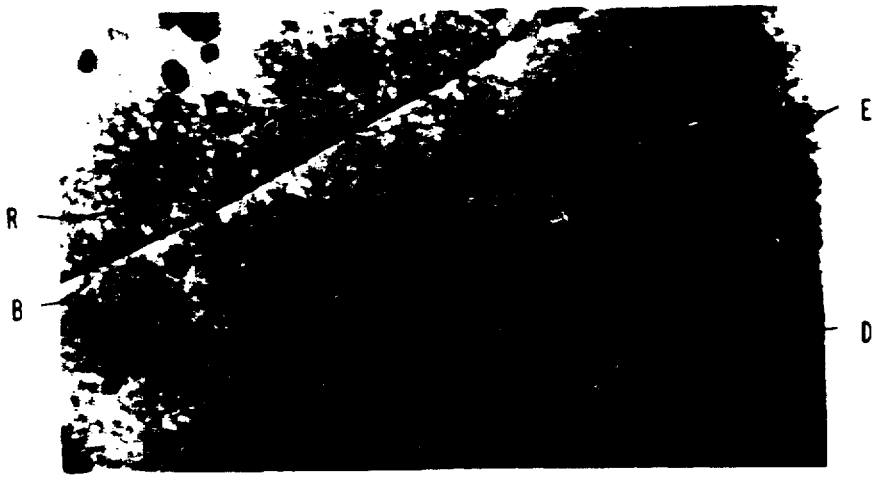
FIG. 1 (PRIOR ART)
Figure 2:
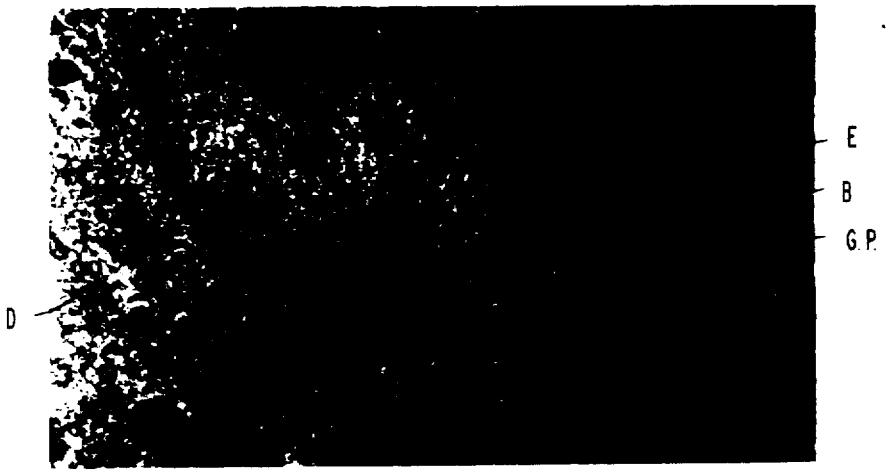
FIG. 2 (PRIOR ART)
Figure 3:
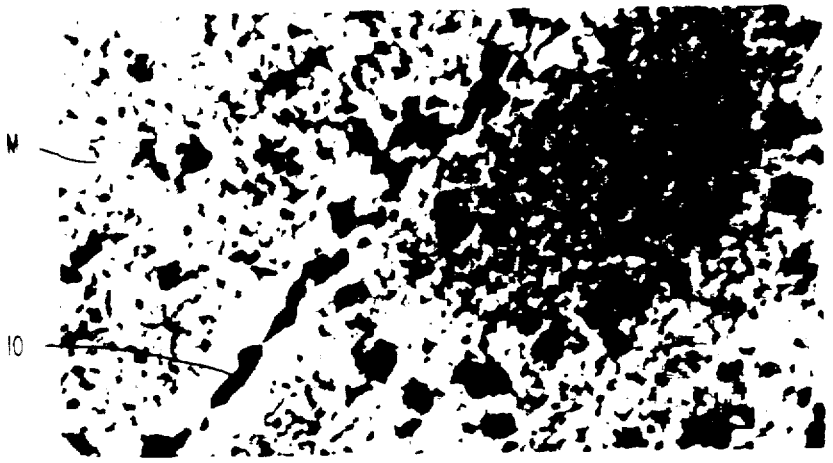
FIG. 3 (PRIOR ART)
Figure 4:
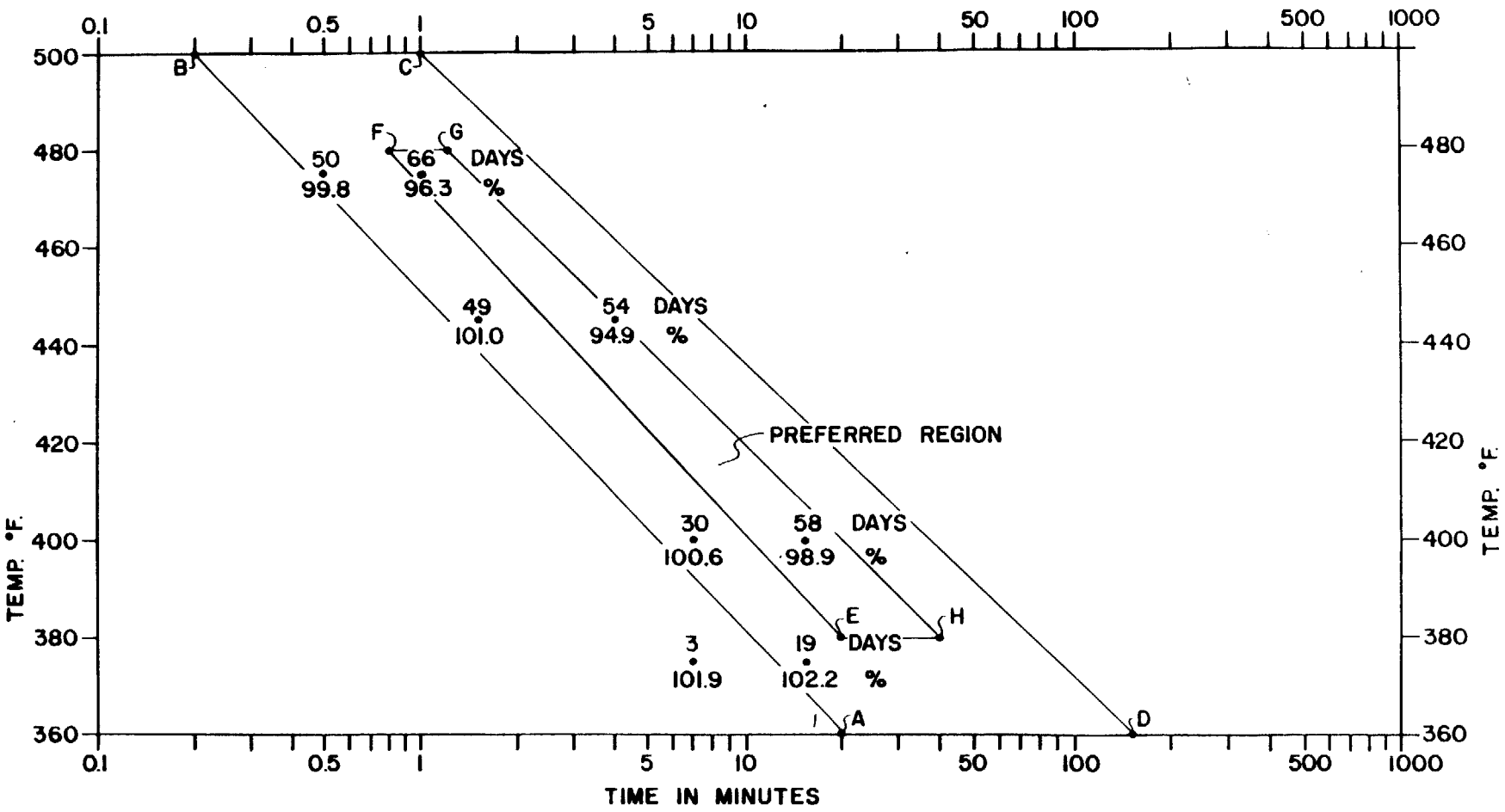
Figure 5:
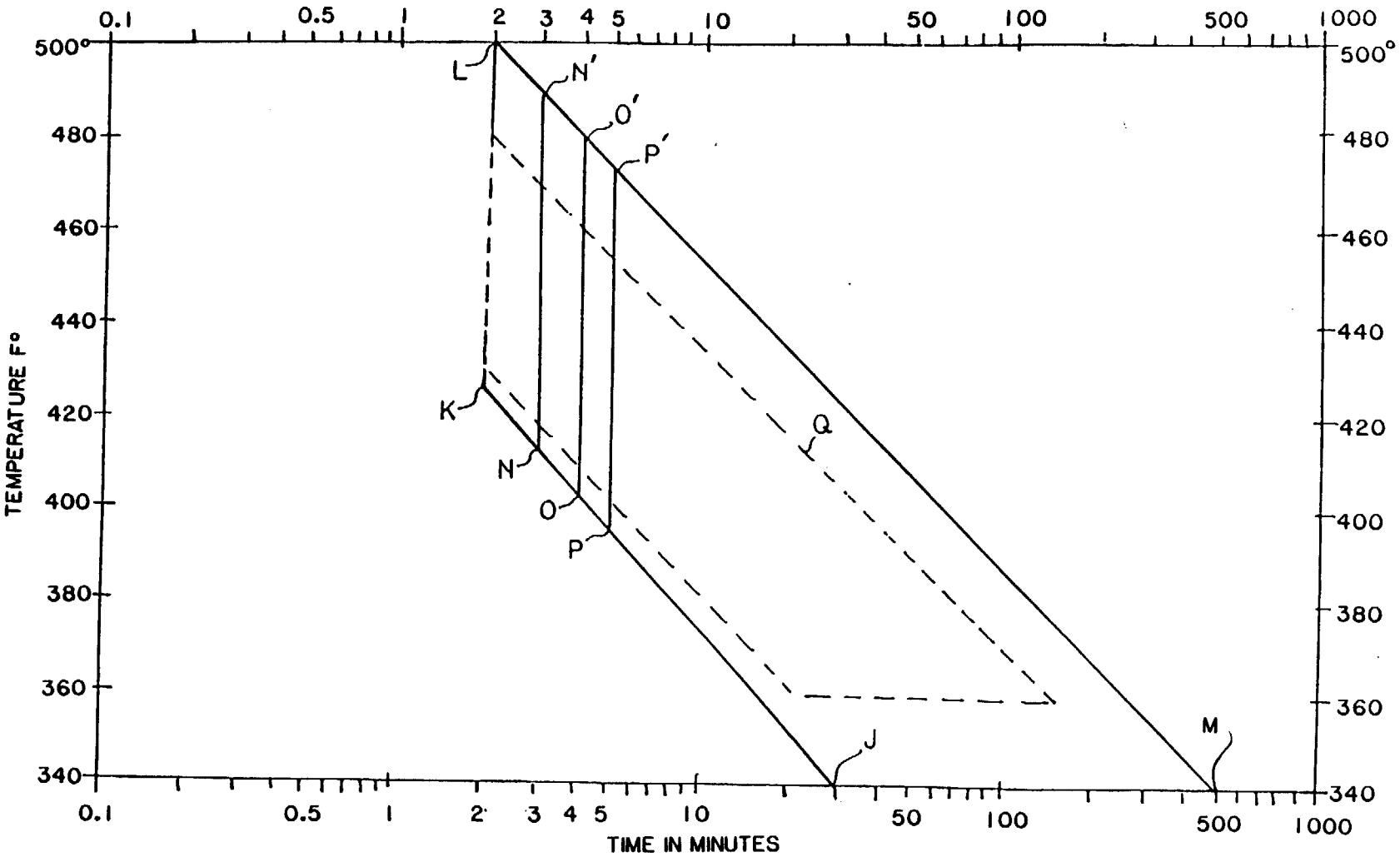
Figure 6:
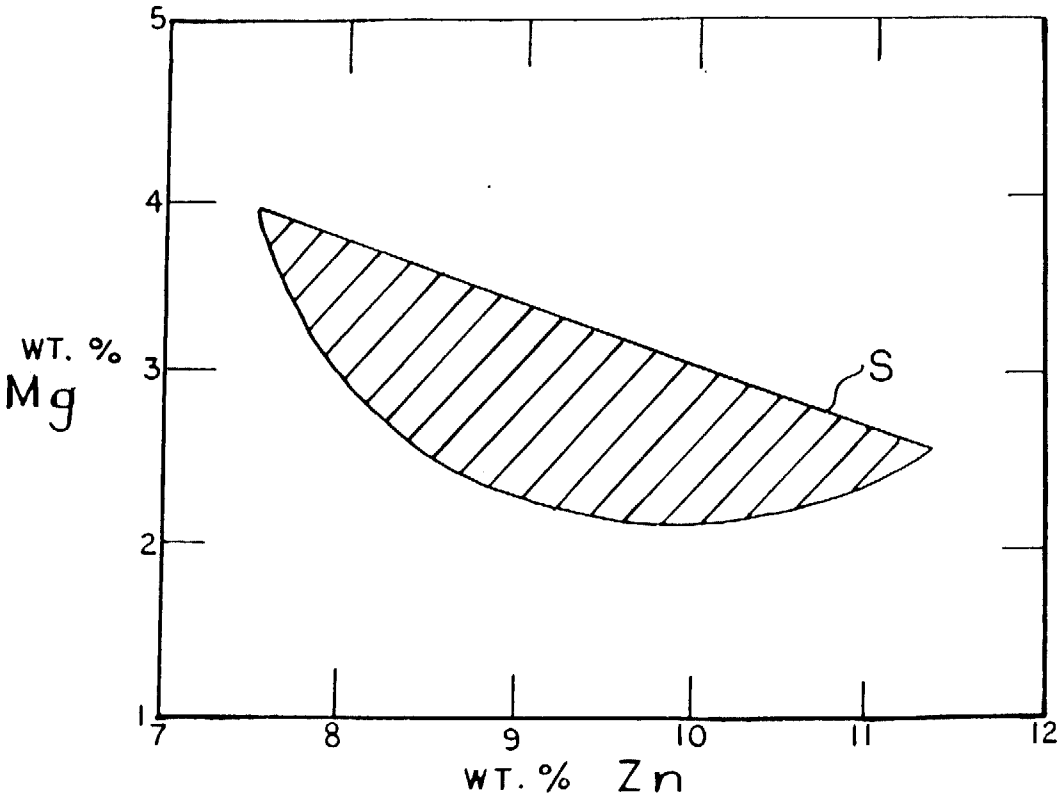

FIG. 6 is a graph showing preferred zinc and magnesium composition ranges for an improved aluminum alloy product containing about 1.5 to 2.5 wt. % copper.

DESCRIPTION OF THE PREFERRED EMBODIMENTS

Alloys in the present invention have a composition containing 4 to 8% zinc, 1.5 to 3.5% magnesium, 1 to 2.5% copper, and at least one element selected from the group made up by chromium at 0.05 to 0.3%, manganese at 0.1 to 0.5%, and zirconium at 0.05 to 0.3%. The balance of the composition is essentially aluminum.

Alloys designated 7075 by the aluminum industry are preferred for one embodiment of the present invention and have a composition containing 5.1 to 6.1% zinc, 2.1 to 2.9% magnesium, 1.2 to 2.0% copper, 0.18 to 0.35% chromium, 0.30% maximum manganese, 0.40% maximum silicon, 0.50% maximum iron, 0.20% maximum titanium, others each 0.05% maximum and others total 0.15% maximum, balance aluminum.

The alloys used in the present invention may also contain one or more of the group of grain refining elements including titanium at 0.01 to 0.2% and boron at 0.0005 to 0.002%. These elements serve to produce a fine grain size in the cast form of the alloy. This is generally advantageous to mechanical properties.

In addition, it may be helpful to add 0.001 to 0.005% beryllium for the purpose of minimizing oxidation at times when the alloy is molten.

Iron and silicon are generally present as impurities. Up to 0.5% iron can be tolerated, and the silicon content should not exceed 0.4%, in order to avoid the formation of any substantial amount of the intermetallic compound $Mg_2Si$.

A preferred heat treatment according to the present invention for obtaining improved stress-corrosion resistance is to immerse the alloy, as above defined, in the precipitation-hardened, T6 condition into molten metal for a time and temperature within the perimeter of the quadrilateral EFGH in FIG. 4, then precipitation harden again.

In its broader aspects, a T6 condition may be obtained by precipitation hardening solution heat treated alloy at 175° to 325° F. Typical conditions may be:

a. For alloys containing less than 7.5% zinc, heating a solution heat treated article to 200° to 275° F. and holding for a period of 5 to 30 hours;

b. For alloys containing more than 7.5% zinc, heating a solution heat treated article to 175° to 275° F. and holding for a period of 3 to 30 hours.

A usual practice for obtaining the T6 condition is obtained by heating a specimen for 24 hours at 250° F. in a circulatory-air furnace.

According to another preferred embodiment of the invention, the alloy is solution heat treated, then precipitation hardened at a temperature of 175° to 325° F., then subjected to a time and temperature within the perimeter ABCD, more preferably EFGH, and then again precipitation hardened for a time of 2 to 30 hours at a temperature of 270° to 320° F.

The article of J. T. Staley et al. entitled "Heat Treating Characteristics of High Strength Al-Zn-Mg-Cu Alloys With and Without Silver Additions" appearing at pages 191 to 199 in the January 1972 issue of *Metallurgical Transactions*, published by ASM/AIME, shows that solution heat treat quench rate, the lapse of time between the solution heat treat quench and the beginning of heating for precipitation hardening, and the heating rate for precipitation hardening may affect the maximum yield strength obtainable in 7075 aluminum alloys. It is intended that, within the concepts of the present invention, the teachings of Staley et al be used in the present invention for optimizing results. Thus, it may be advantageous for increasing strength to immerse specimens, which have had their solution heat treatment quench, for example, 1½ years ago, into molten Wood's metal according to the invention.

Referring now to FIGS. 1 to 3, transmission electron micrographs of various microstructures important for consideration of the present invention are presented. All of FIGS. 1 to 3 were taken from a single ¼-inch thick 7075 aluminum alloy plate of composition A in Table I. FIGS. 1 to 3 are microstructures of prior art conditions of 7075 aluminum. In FIG. 1, an example of the W51 solution heat treated condition is given. A W51 solution heat treated microstructure is obtained in 7075 aluminum alloy plate by heating to 900° F. and then quenching in water at room temperature. The plate material is then stretched to from 1½ to 3% permanent set for stress relief. This gives the microstructure shown in FIG. 1, including E-phase particles of Al-Mg-Cr precipitate, matrix regions R of single phase aluminum solid-solution material, grain boundaries B and dislocations D. The mottling effect appearing in the matrix region of FIG. 1 is an artifact of the action of the thinning solution used in preparing thinned material for transition electron microscopy.

TABLE I

Composition of Alloys, in Weight %

| Element | Alloy A | Alloy B |
|---|---|---|
| Cu | 1.45 | 1.63 |
| Fe | 0.19 | 0.30 |
| Si | 0.09 | 0.12 |
| Mn | 0.02 | 0.07 |
| Mg | 2.40 | 2.48 |
| Zn | 5.92 | 5.68 |
| Ni | 0.00 | 0.00 |
| Cr | 0.18 | 0.19 |
| Ti | 0.02 | 0.05 |
| Be | 0.001 | 0.001 |

FIG. 2 shows the 7075 alloy material of FIG. 1 after it has been brought to the T6, in particular the T651, temper by heating W51 material in a circulatory-air furnace for 24 hours at 250° F. E-phase remains substantially unchanged. Dislocations D and a grain boundary B are shown. Now in the matrix there has appeared many small black dots; these are referred to as G.P. zones and are clusterings of magnesium and zinc atoms generally in the ratio two zinc atoms for each magnesium atom.

FIG. 3 shows a specimen taken from the same plate of FIGS. 1 and 2 in the T73 condition, which is produced from W51 material by heating in circulatory-air furnaces for, first, 24 hours at 250° F. and, second, 8 hours at 350° F. Grain boundary precipitate 10 has appeared, and the G.P. zones have grown to greater size. The G.P. zones have begun to exhibit crystallinity by giving rise to X-ray diffraction patterns and are referred to by those in the art as M' and M-phase. Solution potential studies indicate that the M' and M-phases contain some copper atoms. It is believed that the G.P. zones progress toward crystallinity by becoming first M'-phase, which is still partially coherent with the matrix crystal structure. The M'-phase then changes to M phase, which has a crystal structure different from the matrix. It is believed also that the progression through the M'-phase to the M-phase makes the original G.P. zones increasingly anodic with respect to the matrix and that the resulting anodic particulate matter in the matrix protects against stress-corrosion cracking.

Further illustrative of the present invention are the following examples.

EXAMPLES 1 to 8

For each example, two tensile blanks of dimensions ⅜ inch by ⅜ inch by 2½ inches were cut from a single lot of 2½ inch thick 7075-T651 (metallurgical history as described for FIG. 2) alloy plate such that their lengths were in the short-transverse direction, i.e., in the direction perpendicular to the surface of the plate.

TABLE II

Times and Temperatures in Wood's Metal for Examples 1 to 8 and the Coordinates of Points A to H.

| Example No., or Point | Time, min. | Temperature °F. |
|---|---|---|
| 1 | 0.5 | 475 |
| 2 | 1.0 | 475 |
| 3 | 1.5 | 445 |
| 4 | 4.0 | 445 |
| 5 | 7.0 | 400 |
| 6 | 15.0 | 400 |
| 7 | 7.0 | 375 |
| 8 | 15.0 | 375 |
| A | 20.0 | 360 |
| B | 0.2 | 500 |
| C | 1.0 | 500 |
| D | 150.0 | 360 |
| E | 20.0 | 380 |
| F | 0.8 | 480 |
| G | 1.2 | 480 |
| H | 40.0 | 380 |

The chemical composition of the alloy is as presented for alloy B in Table I. The tensile blanks for each example were immersed in molten Wood's metal of composition 50% bismuth, 25% lead, 12.5% tin and 12.5% cadmium. The immersion temperatures and times are presented in tabular form in Table II and are plotted in FIG. 4. Following immersion in the molten Wood's metal, the cooled specimens were then precipitation hardened by heating them in a circulatory-air furnace for a time of 24 hours at 250° F. In each of Examples 1 to 8, a tensile blank was machined to a 0.125 inch diameter tensile bar for exposure to 3½% sodium chloride solution by alternate immersion at a stress level of 42 ksi according to Military Specification MIL-A-22771B. The specimens were held until failure with successive immersion for 10 minutes in the salt solution followed by 50 minutes in air. The number of days until failure under such treatment is provided in FIG. 4 above the time-temperature point for each example. The remaining blank of each example was tested for yield strength. The yield strength data for Examples 1 to 8 are presented in FIG. 4, below the time-temperature points, in terms of percentage of a yield strength of 62.3 ksi for the T651 condition.

Further illustrative of the preferred embodiment of the invention wherein the second precipitation-hardening step is carried out for 2 to 30 hours at a temperature of 270° and 320° F. are the following examples:

EXAMPLES 9 to 14

Procedure was described for Examples 1 to 8, except that all examples utilized an immersion in molten Wood's metal for 90 seconds at 445° F., before the second precipitation hardening. Other parameters and results were as presented in Table III Examples 9 to 11 form one group of comparative examples characterized by 3 hours at temperature in the second precipitation-hardening step, with Examples 12 to 14 forming a second group characterized by 24 hours at temperature in the second precipitation-hardening step. The superior strength and corrosion resistance obtained when the second precipitation-hardening was done for 2 to 30 hours at 270° to 320° F. will be apparent from comparison of the examples within the groups.

TABLE III

Parameters and Data for Examples 9 to 14, Involving Immersing Aluminum Alloy 7075-T651 in Molten Wood's Metal for 90 seconds At 445° F., Followed by a Second Precipitation Hardening Step

| Example No. | Time (Hours) & Temperature (°F.) of Second Precipitation Hardening | Tensile Strength, ksi | Yield Strength, ksi | Days to Fail 42 ksi load level | Days to Fail 35 ksi load level |
|---|---|---|---|---|---|
| 9 | 3 hrs./250° F. | 67.2 | 58.5 | 27 | 74 |
| 10 | 3 hrs./275° F. | 68.8 | 58.8 | 43 | 62 |
| 11 | 3 hrs./300° F. | 66.8 | 58.1 | 60 | 84 |
| 12 | 24 hrs./250° F. | 70.5 | 62.9 | 49 | 50 |
| 13 | 24 hrs./275° F. | 69.5 | 61.0 | 47 | 61 |
| 14 | 24 hrs./300° F. | 69.6 | 61.4 | 56 | 63 |

The following definitions hold herein:

a. The term "ksi" is equivalent to kilipounds per square inch.

b. Wherever percentages are given, reference is to % by weight, unless indicated otherwise.

c. The initials "G.P." stand for Guinier-Preston.

d. The term "minimum strength" means the level of strength at which 99% of the alloy product is expected to conform with a confidence level of 0.95 using standard statistical methods.

e. The term "ingot-derived" means solidified from liquid metal by a known or subsequently developed casting process rather than through powder metallurgy techniques. This term shall expressly include, but not be limited to, direct chill casting, electromagnetic continuous casting and any variations thereof.

f. In stating a numerical range for an element of a composition or a temperature or any other matter herein, and apart from and in addition to the customary rules for rounding off numbers, such is intended to specifically designate and disclose each number, including each fraction and/or decimal, between the stated minimum and maximum for said range. (For example 6 to 8 discloses 6.1, 6.2, . . . 6.9, 7, 7.1, 7.2, . . . and so on, up to 8. Similarly, 370 to 390 discloses 371, 372, . . . and so on, up to 390.)

The invention has been described to this point with specific reference to alloys containing 4% to 8% zinc, 1.5% to 3.5% magnesium and 1% to 2.5% copper. The invention is considered especially useful for alloys containing higher amounts of zinc such as 6% or 8% to 16% zinc, for instance 8% to 12% zinc. Alloys containing high amounts of zinc are known to exhibit high strength, but these alloys were previously considered of limited usefulness: because of corrosion problems such as exfoliation and stress corrosion cracking. The practice of the invention enables making new products of high zinc aluminum alloys having very high minimum yield strengths of at least about 83 or 85 ksi in sheet, plate or forgings, and for extruded products even higher minimum yield strength levels of about 90 ksi or more, in combination with good corrosion resistance.

The new products in accordance with the invention contain at least 6% zinc, preferably 8% or more zinc in order to achieve the desired high strength. Alloys containing at least 7 or 7.5% zinc are considered useful as are zinc contents of 9 or 10%. The zinc content for the improved products may be as high as 16% or possibly higher, for instance 18 or 20%. A maximum zinc of about 12% is preferred in some embodiments although maximum zinc levels up to as much as 13 or 14 or even 15% may be applied in the practice of this invention. Suitable ranges for zinc include: from about 7.5 or 8% or more up to about 9 or 9.5%; from about 8.5 or 9% up to about 10 or 10.5%, or even 11%; and from about 9.5 or 10% up to about 11.5 or 12%.

The improved aluminum alloy products contain magnesium in minimum amounts of about 1.5% although a minimum of at least 1.75 or 2% is preferred in some embodiments. The maximum amount for magnesium is about 4 or 4.25%, or possibly even 4.5% magnesium. Suitable ranges for magnesium include: from about 1.5% to about 2.5 or 3%; from about 1.7 or 2% up to about 3 or 3.5%; and from about 2% up to about 4 or 4.5%. Copper is present in an amount of at least 1 or 1.5% with the maximum copper being about 2.5 or 2.75%, or in some cases about 3%. Suitable ranges for copper include: from about 1% to about 2%; from about 1.3 or 1.5% up to about 2.5 or 2.7%, or even 3%; and from about 1% to about 2.5 or 3%. One preferred range for copper is about 1.75 or 2% to 2.5 or 2.75%. One range of alloys considered useful in practicing this invention contains from about 8% to about 11 or 11.5% zinc, from about 2% to about 3% magnesium and from about 1.75% to about 2.5% copper. The shaded area S of FIG. 6 sets out one preferred range of zinc and magnesium in accordance with the present invention for an alloy containing about 1.5 to 2.5% copper.

In practicing the invention, it is preferred, especially from the standpoint of toughness and fatigue properties, that the amount of zinc, magnesium and copper not exceed a dissolvable amount, by which is meant an amount that can be brought into solid solution during solution heat treatment such that not more than one volume percent of undissolved intermetallic phases greater than about 1 micron containing Zn, Cu and/or Mg are present after solution heat treating. Preferably, not over one-half volume percent of said intermetallic phases remains. Accordingly, it can be advantageous to limit the combined total of zinc, magnesium and copper to levels not exceeding about 16 or 17%. A preferred minimum for zinc, magnesium and copper should be at least about 12% although total contents of about 11 or 10.5% may also be sufficient. In some embodiments, the amount of copper present exceeds the amount of magnesium present, while in other embodiments, copper is less than or equal to the magnesium amount.

The improved alloy product should contain one or more ancillary elements selected from: up to about 0.2% zirconium, for instance about 0.03 to about 0.15% zirconium; up to about 0.25% chromium, for instance about 0.03 to about 0.2% chromium; up to about 0.2% vanadium, for instance about 0.03 to about 0.15% vanadium; up to about 0.5% hafnium, for instance about 0.03 to 0.4% hafnium; and/or up to about 0.4 or 0.5% manganese, for instance about 0.03 to about 0.35% manganese, although manganese levels up to about 0.8% or possibly 1% or 1.1 or 1.2% may impart further benefit to the improved alloy products. Preferably, the cumulative total for such elements should not exceed about 0.7 or 0.8%, or even about 1%. Where manganese is present above 0.5 or 0.6%, this total level might be as high as 1.3 or 1.4% or possibly even more. In any event, the total quantity of ancillary elements should not exceed an amount which can be maintained in supersaturated solid solution upon solidification of the molten alloy. These ancillary elements are considered to enhance the desired properties in the improved alloy products of the invention by suppressing recrystallization in products hot worked prior to solution heat treating and, in the case of recrystallized products such as some products cold worked by a substantial extent prior to solution heat treatment, controlling recrystallized grain size to fine grain sizes.

It is preferred that the iron and silicon content in the present products be less than about 0.05% each. Impurity levels of up to about 0.1% or more iron and up to about 0.1% or more silicon may also be acceptable but typically on a less preferred basis. On a still less preferred basis, the alloy can contain iron up to about 0.5% and silicon up to about 0.4%.

Some alloys considered suitable in accordance with the invention include those set forth in the following table:

TABLE IV

| | Examples of Alloy | | | | |
|---|---|---|---|---|---|
| Alloy No. | Zn | Mg | Cu | Zr | Mn |
| 1 | 6–8 | 1–2.5 | 1–2.5 | .04–.15 | — |
| 2 | 7.5–9 | 2–3 | 1.5–2.5 | .04–.15 | — |
| 3 | 8–9.5 | 2–3 | 1.5–2.5 | .04–.15 | — |
| 4 | 7.5–9 | 2.2–3.4 | 1.2–2.2 | .04–.15 | — |
| 5 | 8.5–10 | 2.1–3.2 | 1.2–2.2 | .04–.15 | — |
| 6 | 8–10 | 1.5–2.5 | 2–3 | .04–.15 | — |
| 7 | 8–11 | 2–3 | 1.5–2.5 | .04–.15 | — |
| 8 | 9–11.5 | 2–3 | 1.5–2.75 | .04–.15 | — |
| 9 | 9–11 | 2–3 | 1.7–2.6 | .04–.15 | — |
| 10 | 10–11.5 | 2–3 | 1.7–2.6 | .04–.15 | — |
| 11 | 8.5–10 | 1.5–2.5 | 1–2 | — | .5–.8 |
| 12 | 10.5–12 | 1.8–2.8 | 1–2 | — | .5–.8 |
| 13 | 9–11.5 | 1.7–2.6 | 1–2 | .04–.15 | .3–.8 |

Products in accordance with this invention may be formed by the various techniques for producing aluminum alloy products such as rolling, forging, extruding or any other metal working operations. Accordingly, the alloy products produced may include sheet, plate, extrusions, forgings or rods, bars or any other shapes. In some embodiments, it is preferred to have products including thicknesses from about 0.3 or 0.35 inch to about 1.5 or 2 inches, although the invention is considered suitable for producing products having or including other thicknesses in sections thereof.

The improved alloy products are produced by providing an ingot or other suitable working stock from the herein described alloy compositions and working said stock into the desired product, shape or configuration. Prior to working, the working stock can be homogenized by heating to a suitable high temperature, typically between about 860° and 920° F. Alternatively, the alloy may be cast into final shape although wrought or worked products are preferred. After desired working or shaping, the alloy may be solution heat treated by heating to one or more elevated temperatures from about 840° or 850° F. to about 880° or 900° F., or at still higher or lower temperatures depending on alloy composition, lower temperatures being favored with higher zinc content to avoid melting. The solution heat treatment is carried out to take into solid solution substantial portions or preferably substantially all of the zinc, magnesium and copper, it being recognized that physical processes are often not perfect such that every last vestige of these alloying ingredients may not be dissolved. Nonetheless, it is preferred where toughness and fatigue properties are concerned that not more than about one volume percent, preferably 0.5 vol. % or less, of undissolved intermetallic phases over one micron in size containing Zn, Cu and/or Mg remain in the alloy product after solutionizing.

After the aforesaid heating, the alloy is rapidly cooled or quenched by immersion or other suitable treatment in a quenching medium. This usually includes immersing in water, although water sprays or even air chilling may be useful in this respect. After quenching and prior to precipitation hardening, the alloy may be cold worked such as by stretching to relieve internal stresses. The solution heat treated and quenched alloy, with or without cold working, is then considered to be in a precipitation-hardenable condition. It is to be understood that solution heat treating or solutionizing as used herein includes quenching to a suitable lower temperature or a substitute or equivalent therefor so as to render the alloy suited to subsequent treatments described herein.

The precipitation-hardenable alloy is then treated in three steps, phases or treatments, although there may not be clear lines of demarcation between steps or phases. That is, it is known that ramping up to a particular aging temperature and ramping down therefrom are in themselves precipitation treatments which can, and often need to be, taken into account by integrating them, and their precipitation-hardening effects, into the treatment. This effect is described in U.S. Pat. No. 3,645,804, which is incorporated herein by reference. Thus while the three phases of aging according to this invention can be effected in a single furnace operation, properly programmed, they are described herein for purposes of convenience as three phases or treatments. In accordance with the invention, the first phase or treatment precipitation hardens the alloy. Then the second phase treats the alloy at an elevated temperature to increase resistance to exfoliation and stress corrosion cracking (SCC). Then the third phase precipitation hardens the alloy to a high strength level.

In the first phase, the alloy is precipitation hardened to strengthen it to a point at or near peak strength, preferably less than peak strength (underaged strength), or, on a less preferred basis, at peak or slightly overaged strength. This can be effected by treating at one or more temperatures between room temperature and about 330° F., preferably between about 175° and 325° F. This treatment typically can extend a significant period of time, typically between about 2 to 30 or more hours and can occur through a temperature ramp-up to an elevated temperature for the second treatment phase. This precipitation hardening should strengthen the alloy product substantially over the strength achieved immediately after quenching (herein referred to as the as-quenched strength or solution treated strength) by at least 30% of the difference between as-quenched strength and peak yield strength, preferably to about 40% or 50% or more, for instance 60% or 70% or more of the difference between the as-quenched strength, or solution treated strength, and peak strength (the solution-peak strength differential) for the alloy product. Putting it another way, the precipitation-hardening of the alloy entering the second phase or treatment should have carried (increased) the product's strength by at least 30% (preferably more) of the way from as-quenched or solution treated strength (low strength) toward the peak strength.

The first phase can extend until the strength reaches up to about 95% of peak strength or reaches peak strength or even run past peak strength (overaged) back down to 95% of peak strength. However, it can be advantageous in some embodiments to limit the precipitation-hardening in the first phase to an underaged condition not exceeding 95% of peak yield strength. In a preferred embodiment, the alloy contains about 1.7% or more copper and the alloy enters the second phase at a strength increased above solution treated strength by about 70% to about 90% of the strength differential referred to in the immediately preceding paragraph. It is worth noting that alloys containing this copper level can increase in strength during the second treatment phase.

The alloy in the condition just described is then subjected to the second phase or treatment at one or more temperatures above about 340° F. or 350° F., preferably at one or more temperatures within the range of about 360° F. to about 500° F., preferably for more than a few minutes. In general, temperatures of 360° F. or higher are preferred but as the zinc content increases, for instance above 9% or 10% or so, lower temperatures such as 350° F. or 340° F. or even possibly less become more useful than for lower zinc contents. The temperatures employed in the second phase normally exceed those in the first and third phases. In some preferred embodiments, the second treatment phase proceeds by subjecting the alloy to treatment within the perimeter ABCD of FIG. 4 or within the perimeter JKLM of FIG. 5, said treatment producing a cumulative time and temperature effect corresponding to a point within the aforesaid perimeter even though more than one temperature may be utilized during this phase. For instance, the effects of this treatment for a particular alloy can commence at a temperature of about 345° or 350° F. and continue as the temperatures are further increased such that "ramping up" and, or "ramping down" of temperatures between about 345°, 350° or 355° F. and higher temperatures within the aforesaid perimeter can be taken into account and integrated into determining the equivalent aging effect within the aforesaid perimeters ABCD and JKLM. This treatment may proceed for 3 or more minutes at one or more temperatures between about 360° and 490° F.; for 4 or more minutes at one or more temperatures between about 360° and 480° F.; or for 5 or more minutes at one or more temperatures between about 360° and 475° F. The 3, 4, and 5-minute marks of FIG. 5 are shown by lines N-N', O-O' and P-P', respectively. The area of overlap between FIGS. 4 and 5 is shown by dotted perimeter Q in FIG. 5. When referring to heating to one or more temperatures for a time of "x" minutes, such embraces heating to any number of temperatures in the designated range but for a cumulative time of "x" above the lowest temperature in the range. For instance, heating for 5 or more minutes at one or more temperatures from about 360° to 475° F. does not require holding for 5 minutes at each of several temperatures in said range, but rather, that the cumulative time at all temperatures between 360° and 475° F. is 5 minutes or more.

The second treatment phase increases resistance to stress corrosion cracking (S.C.C.), exfoliation and other corrosion effects. Generally speaking, better properties of S.C.C. resistance are achieved when proceeding at times and temperatures closer to line C-D of FIG. 4 and line L-M of FIG. 5, and better strength with good exfoliation resistance are achieved when proceeding in that area closer to lines A-B (FIG. 4) and J-K (FIG. 5). The second phase or treatment can be carried out by immersion in hot liquid such as molten salt, hot oil or molten metal. A furnace (hot air and/or other gases) may also be used. One advantageous practice utilizes a fluidized bed for the second treatment. Suitable media for the fluidized bed include alumina particles of about 50 or 60 mesh. The fluid bed heating media can provide fairly rapid heating (faster than a hot air furnace but slower than molten salt) and uniform heating of large or complex parts while presenting easier clean-up and environmental aspects than some other approaches. Induction heaters may also be used in the practice of the invention.

As indicated elsewhere herein, heating operations can be ramped-up fairly slowly such that much or even all of the treatments, especially the precipitation-hardening treatments of the first and/or third phases, can be accomplished by or during ramping-up to and/or -down from the elevated second phase temperature or temperatures such that there may not be discrete disruptions or interruptions between phases. However, the second phase can be considered to start when the corrosion properties start to improve. This typically involves some time at temperatures of about 360° or so or more after achieving the strengthening (precipitation-hardening) described in the first phase as mentioned hereinbefore. In some embodiments, the second phase can be considered accomplished when the desired degree of corrosion resistance is achieved and the temperature is suitably lowered for third phase precipitation-hardening. However, in some cases, the corrosion resistance can improve in the third phase such that the second phase can be shortened to a level less than the desired corrosion resistance to allow for this effect.

The alloy is then precipitation hardened in the third treatment or phase typically at one or more temperatures between room temperature and about 330° F., typically from about 175° to 325° F. This precipitation-hardening step may proceed at substantially the same temperature or temperatures employed in the earlier precipitation-hardening operation. The times employed are about 2 to 30 or more hours. It is quite desirable in this third phase to utilize substantial exposures, typically for several hours, at one or more temperatures substantially below the higher (or highest) temperatures used in the second phase. During this precipitation-hardening phase, the strength of the product is increased to a very high level, above that accompanying the improved corrosion resistance achieved in the second phase and typically to the desired final yield strength level.

As can be seen from the foregoing, either or both precipitation-hardening phases and/or the intermediate higher temperature treatment can be performed at one or more temperatures by ramping up and/or down within a particular temperature range. As is generally recognized in the art, integration of aging effects under ramp-up or ramp-down conditions is useful in determining the total aging effect as described in U.S. Pat. No. 3,645,804, the disclosure of which is incorporated herein by reference.

It is preferred that the second phase treatment not be carried for time-temperature combinations excessively exceeding the extent needed to develop the desired level of corrosion resistance properties. Use of excessive time-temperature exposure in the second phase can impede the ability of the third phase to achieve the desired high level of strength. Accordingly, preferred practices for some products can include treatments to the left of line C-D in FIG. 4, and even to the left of line G-H (and upward and downward extensions thereof). Also, it may be of advantage in some cases to rapidly cool the product after a desired amount of treatment. Such cooling can be relatively drastic, such as by water quenching (immersion or sprays), or less drastic, such as by removal from the furnace and air or forced air (fans) cooled. Some advantage to rapid cooling from the second treatment, or rapid heating at the commencement of the second phase, can arise in some cases because of improvement in control of time and temperature. Thus, while ramping-up to and/or down from a temperature (more or less gradual heat-up and cool-down) can be employed, especially if ramp-up and ramp-down effects are appropriately accounted for, nonetheless, it may be advantageous in some cases to utilize rapid heat-up and/or rapid cool-down in one or more treatment phases, for instance in the second phase.

The microstructure changes that are believed to occur through the treatment phases just discussed can be of interest in understanding the invention. In the first treatment phase there are a relatively large number of closely spaced small particles containing Mg and Zn formed. The strength rises quite substantially and the overall solution potential of the alloy drops measurably. The microstructure is similar to a T6 microstructure and includes G.P. zones and metastable eta prime ($\eta'$) precipitates in the grain interior, equilibrium eta ($\eta$) ($MgZn_2$) precipitates at the grain boundaries, and zones normally adjacent to the grain boundaries where there is substantially no detectable precipitate (precipitate-free-zone-PFZ). The PFZ contains more Zn and Mg in solution than the matrix further away from the grain boundary. This makes the PFZ electrochemically different (anodic) relative to the matrix in the grain interior such that corrosion can occur preferentially in this PFZ. This gives rise to exfoliation and stress corrosion cracking (S.C.C.) along PFZ's, thereby resulting in reduced resistance to these corrosion effects.

In the second treatment phase, strength can increase or decrease depending on composition and/or the extent of strengthening in the first phase. Solution potential does increase and so does corrosion resistance. The improvement in corrosion resistance is attributed to reducing the electrochemical difference referred to just above by removing more copper from solution in the grain interior region than in the PFZ regions. This is considered to occur as follows. Some or all $\eta'$ (normally copper-free) in the grain interior matrix transforms to copper-free $\eta$ ($MgZn_2$). Dissolved copper leaves solution and converts Cu-free $\eta$ to copper-bearing $\eta$ (Mg(Zn, Cu, Al)), in both the grain boundaries and the grain matrix interior although some copper may possibly otherwise leave solution. The depletion of dissolved copper is more extensive in the grain interior region than the PFZ region, thus reducing the electrochemical (anodic) differential previously referred to. This, in turn, improves corrosion resistance quite substantially.

In the third phase, more $\eta'$ precipitate forms and this improves strength quite significantly.

Thus, the strength-imparting precipitation that occurs in the first phase is accompanied by an anodic differential between the PFZ's immediately adjacent the grain boundaries and the matrix within the grains, which differential causes serious corrosion problems. This anodic differential and the resulting corrosion problems are substantially relieved in the second phase, and the alloy is further strengthened in the third phase.

The alloy products produced in accordance with the invention will exhibit very high levels of minimum or guaranteeable strength, at least about 5% greater than the minimum yield strength levels (compression and tension) for a similarly sized and shaped 7X50 alloy product in the T6 temper. Alloy products of the invention may have minimum yield strengths about 7 or 9%, and up to 12% or more greater than 7X50-T6 counterparts while not suffering from the serious disadvantages previously associated with high zinc alloys. The improved products of the invention will exhibit T7-type levels of resistance to stress corrosion cracking, exfoliation and other corrosion effects while substantially exceeding the minimum strength levels of 7150-T6 products exemplified in Table V below, it being remembered that 7150-T6 is considered a very high strength aluminum alloy in the aerospace industry.

TABLE V

Minimum Yield Strength Levels in Tension (ksi)

| Plate: 7150-T651 Thickness (in.) | Longitudinal (L) Strength | Long Transverse (LT) Strength |
|---|---|---|
| 0.500–0.749 | 78 | 77 |
| 0.750–1.000 | 78 | 78 |
| 1.001–1.500 | 78 | 77 |

| Extrusion: 7150-T651X Registered by Boeing Thickness (in.) | Longitudinal (L) Strength |
|---|---|
| 0.250–0.499 | 78 |
| 0.500–0.749 | 78 |
| 0.750–2.000 | 78 |
| Alcoa-modified 7150-T651X | |
| 0.250–0.499 | 82 |
| 0.500–0.749 | 83 |
| 0.750–2.000 | 84 |

Strength comparisons herein refer to minimum strength, by which is meant the strength level that normal statistical methods would show at 95% confidence that 99% of the samples would equal or exceed. This guaranteeable or design-useful strength is referred to rather than typical values which are higher but not normally used for design purposes. When compared for typical strength, the improved products would show substantially the same levels of improvement (5% or 10% or more over 7X50-T6) as for minimum or guaranteeable values. Improved plate products of the invention will exhibit minimum yield strengths which meet or exceed about 83 ksi, for instance greater than about 85 ksi, 87 ksi or more. Minimum yield strength values of about 90 ksi or more may also be achieved for plate products made according to this invention without suffering unacceptable levels of stress corrosion cracking, exfoliation or other corrosion effects. For improved extruded alloy products of the invention, minimum yield strengths of at least about 87 ksi to 88.5 ksi are achievable depending upon final alloy composition and overall product thickness. It is further considered practical to achieve minimum yield strength levels of about 90 ksi, 93 ksi or 95 ksi or more for thicker extruded shapes at acceptable levels of corrosion resistance. Minimum yield strengths in the neighborhood of about 100 ksi or higher may also be achieved without sacrificing acceptable corrosion resistance.

The improved products can exhibit corrosion resistance properties which meet or exceed those of 7X50 alloy products in T7-type tempers, for instance the T76 condition. This means that the improved products will be capable of surviving 20 days or more of alternate immersion testing in a 3.5% NaCl solution without cracking while under a constant stress of about 25 ksi or more. The practice of the invention may provide certain alloy products having stress corrosion cracking resistance levels which will survive 20 or more days of alternate immersion testing at stresses of about 35 ksi or more without cracking (the T74 temper). The resulting alloy product will further possess exfoliation resistances which meet or exceed those of the T76 and, more preferably, the T74 conditions listed in Table VI.

In Table VI, commercial corrosion resistance performance standards for T73, T74 and T76 tempers are set forth. Any product designated T76 must be capable of passing the T76 tests, and so on. The SCC test is based on the stress level that the product can sustain in a 20-day SCC test conducted by alternate immersion in accordance with ASTM Standard G44-75, incorporated herein by reference. In this test, short transverse specimens ¼ inch (3.2 mm) in diameter are stressed in constant strain fixtures. The test specimens are then alternately exposed to 10 minutes immersion in a 3.5% aqueous NaCl solution and a 50-minute drying cycle while under a constant stress value (ksi). The test is carried out for 20 days (less if the specimen fails in less than 20 days). The exfoliation test is the EXCO test, ASTM Standard G34-72, -79, incorporated herein by reference.

TABLE VI

| | Corrosion Resistance Standards | |
|---|---|---|
| Temper | SCC Test Stress (ksi) | Exfoliation Requirement EXCO Test |
| T73 | 42 | P - pitting; little or no exfoliation |
| T74 | 35 | EA - slight or superficial exfoliation |
| T76 | 25 | EB - Moderate - more exfoliation than EA but still acceptable |

As can be seen, T73 is the most corrosion resistant temper in Table VI, with T74 and T76 being progressively less resistant but progressively stronger. The T6 temper normally fails all of these tests and is not considered well suited where stress corrosion cracking is a concern or where exfoliation corrosion could present a problem. Alloy 7050 (U.S. Pat. No. 3,881,966) is often sold in T74 and T76 tempers, whereas substantially identical alloy 7150 is typically sold in T6-type tempers because of its higher strength.

The present invention will enable achieving a substantial increase in strength over 7150 and 7050 products at equivalent levels of corrosion resistance. The invention can produce strength levels as much as 5 or 7% and more, such as increases of 9 or 10%, or even 12% or more greater than 7X50-T6. Moreover, T76-type corrosion resistance, or better, combined with such strength increases over the high strength levels of 7150-T651 will also be achievable in practicing the invention. Such combinations of high strength together with T76 corrosion resistance are extremely valuable in aerospace and other high strength aluminum alloy applications.

Having described the presently preferred embodiments, it is to be understood that the invention may be otherwise embodied within the scope of the appended claims which are intended to embrace all equivalents and all embodiments within the spirit of the invention.

What is claimed is:

1. A method for producing an aluminum alloy product having improved combinations of strength and corrosion resistance properties, said method comprising:
   (a) providing an alloy consisting essentially of about 6–16% zinc, about 1.5–4.5% magnesium, about 1–3% copper, one or more elements selected from zirconium, chromium, manganese, titanium, vanadium and hafnium, the total of said elements not exceeding about 1%, the balance aluminum and incidental elements and impurities;
   (b) solution heat treating the alloy;
   (c) precipitation hardening the alloy above room temperature to increase its strength to a level exceeding as-solution heat treated strength by at least about 30% of the difference between as-solution heat treated strength and peak strength;
   (d) subjecting the alloy to treatment at one or more temperatures sufficient for improving the corrosion resistance properties of said alloy; and
   (e) precipitation hardening the alloy above room temperature;
   (f) the cumulative time at temperatures which are sufficient to improve corrosion resistance in said recitation (d) being more than about three minutes and sufficient to improve corrosion resistance but not so long as to prevent a significant strength increase in said recitation (e).

2. The method of claim 1 wherein the alloy contains about 7.5 to about 12% zinc.

3. The method of claim 2 wherein the alloy contains about 9 to about 11% zinc.

4. The method of claim 1 wherein the alloy contains about 2 to about 4% magnesium.

5. The method of claim 1 wherein the alloy contains about 1.5 to about 2.5% copper.

6. The method of claim 1 wherein the alloy contains about 0.3 to about 0.8% manganese.

7. The method of claim 1 wherein the alloy further contains up to about 0.1% impurities including iron and silicon.

8. The method of claim 1 wherein the alloy contains more magnesium than copper.

9. The method of claim 1 wherein the alloy contains more copper than magnesium.

10. The method of claim 1 wherein recitation (c) includes heating the alloy to one or more temperatures below about 340° F.

11. The method of claim 10 wherein recitation (c) includes precipitation hardening the alloy at one or more temperatures between room temperature and about 330° F.

12. The method of claim 1 wherein recitations (c) and (e) include subjecting the alloy to one or more temperatures within about 175° to 325° F.

13. The method of claim 1 wherein recitation (d) includes subjecting the alloy to one or more temperatures within about 350° to 500° F.

14. The method of claim 1 wherein recitation (d) includes subjecting the alloy to treatment for a cumulative time-temperature effect substantially within ABCD of FIG. 4, said treatment extending for a cumulative time of four or more minutes at temperatures between about 360° and 480° F.

15. The method according to claim 14 wherein more than one temperature is used in recitation (d).

16. The method according to claim 1 wherein recitation (d) includes subjecting the alloy to one or more temperatures within about 360° to 475° F. for a cumulative time within 360° to 475° F. of about five or more minutes.

17. The method of claim 1 wherein recitation (d) includes subjecting the alloy to treatment for cumulative time temperature effect substantially within JKLM of FIG. 5.

18. The method according to claim 17 wherein more than one temperature is used in recitation (d).

19. The method of claim 1 wherein the alloy product produced has at least about 5% greater yield strength than a similarly-sized 7X50-T6 alloy product and has corrosion resistance properties which meet or exceed those of a 7X50-T76 alloy product.

20. The method of claim 1 wherein the alloy product produced: (i) has about 7% or more greater yield strength than a similarly-sized 7X50-T6 alloy product; (ii) is capable of surviving at least about 20 days of alternate immersion testing in a 3.5% NaCl solution without cracking under a stress of about 25 ksi or more; and (iii) has an exfoliation resistance level of "EB" or better.

21. A method for improving the strength, toughness and corrosive resistance properties of a solution heat treated 7XXX aluminum alloy containing about 7 to about 12% zinc; about 1.5 to about 2.7% magnesium; about 1 to about 3% copper; the total zinc, magnesium and copper content not exceeding an amount which will cause more than one volume percent of undissolved intermetallic phases containing said elements to remain after solution heat treating, said alloy further containing one or more elements selected from: up to about 0.2% zirconium, up to about 0.25% chronium, up to about 0.8% manganese, up to about 0.2% vanadium and up to about 0.5% hafnium, said method comprising:

(a) precipitation hardening the alloy at one or more temperatures above room temperature but below about 340° F.;

(b) subjecting the alloy to treatment at one or more temperatures above about 340° F. and (c) precipitation hardening the alloy at one or more temperatures above room temperature but below about 340° F.;

(d) the cumulative time at temperatures above about 340° F. in said recitation (b) being more than three minutes but not so long as to prevent a significant strength increase in said recitation (c).

22. The method of claim 21 wherein the alloy contains about 7.5 to about 11.5% zinc, about 1.7 to about 2.3% magnesium and about 1.2 to about 3% copper.

23. The method of claim 21 wherein the alloy further contains up to about 0.08% iron and up to about 0.08% silicon.

24. The method of claim 21 wherein recitations (a) and (c) include heating the alloy at one or more temperatures between about 175 ° and 325° F.

25. The method of claim 21 wherein recitation (b) includes heating the alloy at one or more temperatures from about 360° F. to about 500° F.

26. The method of claim 21 wherein recitation (b) includes heating the alloy for a time-temperature equivalence substantially within JKLM of FIG. 5.

27. A method for producing aluminum alloy product having a minimum yield strength at least about 5% greater than the minimum yield strength for a similarly-sized 7X50-T6 alloy product and having corrosion resistance properties which meet or exceed those of a 7X50-T76 alloy product, said method comprising:

(a) providing an alloy consisting essentially of about 7 to about 12% zinc, about 1.5 to about 2.7% magnesium, about 1 to about 3% copper, the total zinc, magnesium and copper content not exceeding an amount which will substantially enter into solid solution during solution heat treatment, said alloy further including one or more elements selected from: up to about 0.2% zirconium, up to about 0.25% chromium, up to about 0.8% manganese, up to about 0.2% vanadium and up to about 0.5% hafnium, the balance aluminum and incidental elements and impurities;

(b) working said alloy into wrought condition;

(c) solution heat treating the alloy;

(d) precipitation hardening the alloy for about 2 or more hours in a first elevated temperature range to increase its strength;

(e) subjecting the alloy to one or more temperatures within about 340° to 500° F. for a cumulative time at temperatures within 340° to 500° F. of four minutes or more to impart to said alloy time-temperature equivalence substantially within the perimeter JKLM of FIG. 5; and (f) precipitation hardening the alloy in the first temperature range to further improve its strength, said method imparting to the alloy improved combinations of strength and corrosion resistance properties.

28. The method of claim 27 wherein the alloy contains about 0.3 to about 0.8% manganese.

29. The method of claim 27 wherein the alloy further contains up to about 0.1% impurities including iron and silicon.

30. The method of claim 27 wherein the first temperature range is between about 175° and 325° F.

31. An improved ingot derived alloy wrought product consisting essentially of about 7 to 12% zinc, about 1.5 to 2.7% magnesium, about 1.75 to 3% copper, one or more elements selected from 0.05 to 0.2% zirconium, 0.05 to 0.4% manganese, 0.03 to 0.2% vanadium and 0.03 to 0.5% hafnium, the total of said elements not exceeding about 1%, the balance aluminum and incidental elements and impurities, said alloy product having at least about 5% greater yield strength than a similarly-sized 7X50-T6 product and having corrosion resistance properties which meet or exceed those of a 7X50-T76 product.

32. The alloy product of claim 31 which contains about 7 to 9.5% zinc, about 1.5 to 2.5% magnesium, about 1.8 to 3% copper and about 0.05 to 0.2% zirconium.

33. The alloy product of claim 31 which contains about 9.5 to 11.5% zinc, about 1.5 to 2.5% magnesium, and about 0.05 to 0.2% zirconium.

34. The alloy product of claim 31 which contains about 8 to 10% zinc, about 1.5 to 2.5% magnesium, about 2 to 3% copper and about 0.05 to 0.2% zirconium.

35. The alloy product of claim 31 which contains about 10.5 to 12% zinc, about 1.8 to 2.8% magnesium, and about 0.05 to 0.2% zirconium.

36. The alloy product of claim 31 which contains about 0.3 to 0.8% manganese.

37. The alloy product of claim 31 which is plate having at least about 83 ksi yield strength.

38. The alloy plate product of claim 37 wherein the yield strength is about 85 ksi or more.

39. The alloy product of claim 31 which is an extrusion having at least about 87 ksi yield strength.

40. The alloy extrusion product of claim 39 wherein the yield strength is about 90 ksi or more.

41. The alloy product of claim 31 which is capable of surviving at least about 20 days of alternate immersion testing in a 3.5% NaCl solution without cracking under a stress of about 25 ksi or more, said alloy product having an exfoliation resistance level of "EB" or better.

42. An ingot-derived wrought alloy product which consists essentially of about 7 to 12% zinc, about 1.5 to 2.7% magnesium, about 1.75 to 3% copper, one or more elements selected from 0.05 to 0.2% zirconium, 0.05 to 0.4% manganese, 0.03 to 0.2% vanadium and 0.03 to 0.5% hafnium, the total of said elements not exceeding about 1%, the balance aluminum and incidental elements and impurities, said alloy product having at least about 83 ksi yield strength and having an exfoliation resistance level of "EB" or better and good toughness.

43. The alloy product of claim 42 which contains one or more of: 0.05 to 0.2% zirconium, 0.03 to 0.2% vanadium and 0.03 to 0.5% hafnium.

44. The alloy product of claim 42 which has at least about 7% greater yield strength than a similarly-sized 7X50-T6 alloy product.

45. The alloy product of claim 44 which has at least about 9% greater yield strength than the 7X50-T6 alloy product.

46. The alloy product of claim 42 which is capable of surviving at least about 20 days of alternate immersion testing in a 3.5% NaCl solution without cracking under a stress of about 25 ksi or more.

47. The alloy product of claim 42 which is capable of surviving at least about 20 days of alternate immersion testing in a 3.5% NaCl solution without cracking under a stress of about 35 ksi or more, said alloy product having an exfoliation resistance level of "EA" or better.

48. An aluminum alloy product characterized by improved strength, toughness and corrosion resistance properties, said alloy product comprising an alloy consisting essentially of about 7 to 12% zinc, about 1.5 to 2.7% magnesium, about 1 to 3% copper, the total weight of zinc, magnesium and copper not exceeding about 15%, one or more elements selected from: up to about 0.2% zirconium, up to about 0.25% chromium, up to about 0.8% manganese, up to about 0.2% vanadium and up to about 0.5% hafnium, the balance aluminum and incidental elements and impurities, said alloy product having been solution heat treated and:

(a) precipitation hardened at one or more elevated temperatures to increase its relative strength;

(b) subjected to treatment for four or more minutes at one or more temperatures sufficient to improve its corrosion resistance properties; and (c) precipitation hardened to raise its yield strength to a level at least about 5% greater than that for a similarly-sized 7X50-T6 alloy product;

(d) the cumulative time at temperatures sufficient to improve corrosion resistance in said recitation (b) not being so long as to prevent a sufficient strength increase in said recitation (c).

49. The alloy product of claim 48 which is plate having about 83 ksi minimum yield strength and an exfoliation resistance level of "EB" or better.

50. The alloy plate product of claim 49 wherein the minimum yield strength is about 85 ksi or more.

51. The alloy product of claim 48 which is an extrusion having about 87 ksi minimum yield strength and an exfoliation resistance level of "EB" or better.

52. The alloy extrusion product of claim 51 wherein the minimum yield strength is about 90 ksi or more.

53. A method for thermally treating an alloy product consisting essentially of about 7 to 12% zinc, about 1.5 to 2.7% magnesium, about 1 to 3% copper and up to about 0.2% zirconium, the balance aluminum and incidental elements and impurities, said method including: (a) solution heat treating the alloy product; (b) precipitation hardening the alloy product in a first temperature range above room temperature and below about 330° F.; (c) subjecting the alloy product to treatment in a second temperature range above the first temperature range for greater than three minutes but not so long as to prevent imparting a substantial strength increase to the alloy product during subsequent treatment; and (d) precipitation hardening the alloy product in a third temperature range above room temperature and below the second temperature range.

54. The method as claimed in claim 53 wherein the first and third temperature ranges are between about 175°–325° F.

55. The method as claimed in claim 53 wherein recitation (c) extends for about five or more minutes and corresponds to time-temperature equivalence substantially within ABCD of FIG. 4.

56. The method as claimed in claim 53 wherein recitation (c) corresponds to time-temperature equivalence substantially within JKLM of FIG. 5.

57. A method for thermally treating a wrought aluminum alloy consisting essentially of about 7.5 to 11.5% zinc, about 1.5 to 2.5% magnesium, about 1.2 to 3% copper and up to about 0.2% zirconium, said method comprising: (a) providing the alloy in a precipitation-hardenable condition; (b) precipitation hardening the alloy including heating within about 175°–325° F.; (c) subjecting the alloy to treatment for more three minutes at one or more temperatures sufficient for improving its corrosion resistance properties, said treatment imparting a cumulative time-temperature equivalence substantially within JKLM of FIG. 5; and (d) precipitation hardening the alloy including heating within about 175°–325° F. to raise its relative strength.

58. The method as claimed in claim 57 wherein recitation (c) includes heating the alloy to one or more temperatures within about 360° to 500° F. for a cumulative time within 360° to 500° F. of about four minutes or more.

59. The method as claimed in claim 57 wherein recitation (c) includes heating the alloy to one or more temperatures within about 340° to 500° F. for a cumulative time within 340° to 500° F. of about four minutes or more.

60. A method for treating a 7XXX aluminum alloy containing about 7 to 12% zinc, about 1.5 to 2.7% magnesium, about 1 to 3% copper, up to about 0.2% zirconium, up to about 0.25% chromium, up to about 0.8% manganese, up to about 0.2% vanadium and up to about 0.5% hafnium, said method comprising:

(a) providing the alloy in a wrought precipitation-hardenable condition;

(b) subjecting the alloy to one or more precipitation-hardening temperatures above room temperature to effect some precipitation therein;

(c) treating the alloy for a cumulative time of about four or more minutes at one or more elevated temperatures sufficient to improve the corrosion resistance of said alloy, said treatment imparting to the alloy time- temperature equivalence substantially within ABCD of FIG. 4; and (d) subjecting the alloy to one or more precipitation-hardening temperatures above room temperature to improve the strength of said alloy.

61. The method according to claim 60 wherein either or both of recitations (b) and (d) include subjecting said alloy to one or more temperatures within about 175° and 325° F.

62. The method according to claim 60 wherein recitation (c) includes heating the alloy to one or more temperatures within 340° to 500° F. for a cumulative time within 340° to 500° F. of five minutes or more.

63. The method according to claim 60 wherein the alloy contains about 7 to 9.5% zinc, about 1.5 to 2.5% magnesium, about 1.8 to 3% copper and about 0.03 to 0.2% zirconium.

64. The method according to claim 60 wherein the alloy contains about 9.5 to 11.5% zinc, about 1.5 to 2.5% magnesium, about 1 to 2% copper and about 0.03 to 0.2% zirconium.

65. The method according to claim 60 wherein the alloy contains about 8 to 10% zinc, about 1.5 to 2.5% magnesium, about 2 to 3% copper and about 0.03 to 0.2% zirconium.

66. The method according to claim 60 wherein the alloy contains about 10.5 to 12% zinc, about 1.8 to 2.8% magnesium, about 1 to 2% copper and about 0.03 to 0.2% zirconium.

67. A method for treating a 7XXX aluminum alloy containing about 7 to 12% zinc, about 1.5 to 2.7% magnesium, about 1 to 3% copper, up to about 0.2% zirconium, up to about 0.25% chromium, up to about 0.8% manganese, up to about 0.2% vanadium and up to about 0.5% hafnium, said method comprising:

(a) providing the alloy in a precipitation-hardenable condition;

(b) subjecting the alloy to one or more precipitation-hardening temperatures above room temperature to effect some precipitation therein;

(c) subjecting the alloy to treatment at one or more temperatures sufficient to improve the corrosion resistance thereof;

(d) subjecting the alloy to one or more precipitation-hardening temperatures above room temperature to significantly increase the strength of said alloy;

(e) the cumulative time at temperatures sufficient to improve corrosion resistance in recitation (c) being about four minutes or more but not so long as to prevent imparting a strength increase to the alloy in recitation (d).

68. The method according to claim 67 wherein either or both recitations (b) and (d) include subjecting said alloy to one or more temperatures within about 175° to 325° F.

69. The method according to claim 67 wherein recitation (c) produces time-temperature equivalence substantially within ABCD of FIG. 4.

70. The method according to claim 67 wherein the cumulative time in recitation (e) is from about 5 minutes to about two and one-half hours.

71. The method according to claim 67 wherein the alloy contains about 7 to 9.5% zinc, about 1.5 to 2.5% magnesium, about 1.8 to 3% copper and about 0.03 to 0.2% zirconium.

72. The method according to claim 67 wherein the alloy contains about 9.5 to 11.5% zinc, about 1.5 to 2.5% magnesium, about 1 to 2% copper and about 0.03 to 0.2% zirconium.

73. The method according to claim 67 wherein the alloy contains about 8 to 10% zinc, about 1.5 to 2.5% magnesium, about 2 to 3% copper and about 0.03 to 0.2% zirconium.

74. The method according to claim 67 wherein the alloy contains about 10.5 to 12% zinc, about 1.8 to 2.8% magnesium, about 1 to 2% copper and about 0.03 to 0.2% zirconium.

75. A method for treating a 7XXX aluminum alloy containing about 7 to 12% zinc, about 1.5 to 2.7% magnesium, about 1 to 3% copper, up to 0.2% zirconium, up to about 0.25% chromium, up to about 0.8% manganese, up to about 0.2% vanadium and up to about 0.5% hafnium, the balance aluminum and incidental elements and impurities, said method comprising:

(a) providing the alloy in a wrought precipitation-hardenable condition;

(b) subjecting the alloy to one or more temperatures within about 175° to 325° F. to effect some precipitation therein;

(c) subjecting the alloy to treatment at on or more temperatures within about 360° to 500° F.; and (d) subjecting the alloy to one or more temperatures within about 175° to 325° F. to increase the strength of said alloy;

(e) the cumulative time spent at temperatures within about 360° to 500° F. in recitation (c) being from about 4 minutes to about two-and-one-half hours but not so long as to prevent imparting a strength increase in said recitation (d).

76. The method according to claim 75 wherein recitation (c) imparts to the alloy time-temperature equivalence substantially within ABCD of FIG. 4.

77. The method according to claim 75 wherein the alloy contains about 7 to 9.5% zinc, about 1.5 to 2.5% magnesium, about 1.8 to 3% copper and about 0.03 to 0.2% zirconium.

78. The method according to claim 75 wherein the alloy contains about 9.5 to 11.5% zinc, about 1.5 to 2.5% magnesium, about 1 to 2% copper and about 0.03 to 0.2% zirconium.

79. The method according to claim 75 wherein the alloy contains about 8 to 10% zinc, about 1.5 to 2.5% magnesium, about 2 to 3% copper and about 0.03 to 0.2% zirconium.

80. The method according to claim 75 wherein the alloy contains about 10.5 to 12% zinc, about 1.8 to 2.8% magnesium, about 1 to 2% copper and about 0.03 to 0.2% zirconium.

81. A method for treating a 7XXX aluminum alloy containing about 7 to 12% zinc, about 1.5 to 2.7% magnesium, about 1 to 3% copper, up to about 0.25% chromium, up to about 0.8% manganese, up to about 0.2% vanadium and up to about 0.5% hafnium, said method comprising:

(a) providing said alloy in a wrought precipitation-hardenable condition;

(b) subjecting said alloy to one or more temperatures within about 175° to 325° F. to effect some precipitation therein;

(c) increasing the temperature of said alloy to one or more temperatures within about 360° to 500° F. for subjecting it to treatment for a cumulative time within about 360° to 500° F. from about 4 minutes to about two-and-one-half hours, said treatment corresponding to time-temperature equivalence substantially within ABCD of FIG. 4; and (d) subjecting said alloy to one or more temperatures within about 175° to 325° F. to improve its strength.

82. The method according to claim 81 wherein the alloy contains about 7 to 9.5% zinc, about 1.5 to 2.5% magnesium, about 1.8 to 3% copper and about 0.03 to 0.2% zirconium.

83. The method according to claim 81 wherein the alloy contains about 9.5 to 11.5% zinc, about 1.5 to 2.5% magnesium, about 1 to 2% copper and about 0.03 to 0.2% zirconium.

84. The method according to claim 81 wherein the alloy contains about 8 to 10% zinc, about 1.5 to 2.5% magnesium, about 2 to 3% copper and about 0.03 to 0.2% zirconium.

85. The method according to claim 81 wherein the alloy contains about 10.5 to 12% zinc, about 1.8 to 2.8% magnesium, about 1 to 2% copper and about 0.03 to 0.2% zirconium.

86. A method-for treating a 7XXX aluminum alloy containing about 7 to 12% zinc, about 1.5 to 2.7% magnesium, about 1 to 3% copper, up to about 0.2% zirconium, up to about 0.25% chromium, up to about 0.8% manganese, up to about 0.2% vanadium and up to about 0.5% hafnium, the balance aluminum and incidental elements and impurities, said method comprising:

(a) providing the alloy in a wrought precipitation-hardenable condition;

(b) subjecting the alloy to one or more temperatures within about 175° to 325° F. for a cumulative time within 175° to 325° F. of about two hours or more to impart some precipitation therein;

(c) subjecting the alloy to treatment within a range of about 340° to 500° F. for a cumulative time within said range from about 5 minutes to about two-and-one-half hours, said treatment corresponding to time-temperature equivalence substantially within ABCD of FIG. 4; and (d) subjecting the alloy to one or more temperatures within about 175° to 325° F. for a cumulative time within 175° to 325° F. of about two hours or more to significantly increase its relative strength.

87. The method according to claim 86 wherein the alloy contains about 7 to 9.5% zinc, about 1.5 to 2.5% magnesium, about 1.8 to 3% copper and about 0.03 to 0.2% zirconium.

88. The method according to claim 86 wherein the alloy contains about 9.5 to 11.5% zinc, about 1.5 to 2.5% magnesium, about 1 to 2% copper and about 0.03 to 0.2% zirconium.

89. The method according to claim 86 wherein the alloy contains about 8 to 10% zinc, about 1.5 to 2.5% magnesium, about 2 to 3% copper and about 0.03 to 0.2% zirconium.

90. The method according to claim 86 wherein the alloy contains about 10.5 to 12% zinc, about 1.8 to 2.8% magnesium, about 1 to 2% copper and about 0.03 to 0.2% zirconium.

91. A method for treating a 7XXX aluminum alloy containing about 7 to 12% zinc, about 1.5 to 2.7% magnesium, about 1 to 3% copper and one or more elements selected from zirconium, chromium, manganese, vanadium and hafnium, the total of said elements not exceeding about 1%, comprising:

(a) providing the alloy in a solution heat treated condition;

(b) subjecting the alloy to one or more temperatures within about 175° to 325° F. for a substantial cumulative time within about 175° to 325° F.;

(c) subjecting the alloy to one or more temperatures within about 340° to 500° F. for a cumulative time within about 340° to 500° F. from about four minutes to about two and one-half hours; and (d) subjecting the alloy to one or more temperatures within about 175° to 325° F. for a cumulative time within about 175° to 325° F. sufficient to increase the strength of said alloy;

(e) said subjecting in recitation (c) not being excessive to obtaining a strength increase in recitation (d).

92. The method according to claim 91 wherein said subjecting in recitation (c) imparts time-temperature equivalence substantially within ABCD of FIG. 4.

93. The method according to claim 91 wherein said subjecting in recitation (c) imparts time-temperature equivalence substantially within JKLM of FIG. 5.

94. The method according to claim 91 wherein the alloy contains about 7 to 9.5% zinc, about 1.5 to 2.5% magnesium, about 1.8 to 3% copper and about 0.03 to 0.2% zirconium.

95. The method according to claim 91 wherein the alloy contains about 9.5 to 11.5% zinc, about 1.5 to 2.5% magnesium, about 1 to 2% copper and about 0.03 to 0.2% zirconium.

96. The method according to claim 91 wherein the alloy contains about 8 to 10% zinc, about 1.5 to 2.5% magnesium, about 2 to 3% copper and about 0.03 to 0.2% zirconium.

97. The method according to claim 91 wherein the alloy contains about 10.5 to 12% zinc, about 1.8 to 2.8% magnesium, about 1 to 2% copper and about 0.03 to 0.2% zirconium.

98. A method for treating a 7XXX aluminum alloy containing about 7 to 12% zinc, about 1.5 to 2.7% magnesium, about 1 to 3% copper, and up to about 1% of one or more elements selected from zirconium, chromium, manganese, vanadium and hafnium, said method comprising:

(a) providing the alloy in a solution heat treated condition;

(b) subjecting the alloy to one or more temperatures within about 175° to 325° F. for a cumulative time within about 175° to 325° F. of about three hours or more;

(c) subjecting the alloy to one or more temperatures within about 360° to 500° F. for a cumulative time within about 360° to 500° F. from about 4 minutes or more to about two and one-half hours for imparting to the alloy time-temperature equivalence substantially within ABCD of FIG. 4; and (d) subjecting the alloy to one or more temperatures within about 175° to 325° F. for a cumulative time within about 175° to 325° F. of about 2 hours or more.

99. The method according to claim 98 wherein the alloy contains about 7 to 9.5% zinc, about 1.5 to 2.5% magnesium, about 1.8 to 3% copper and about 0.03 to 0.2% zirconium.

100. The method according to claim 98 wherein the alloy contains about 9.5 to 11.5% zinc, about 1.5 to 2.5% magnesium, about 1 to 2% copper and about 0.03 to 0.2% zirconium.

101. The method according to claim 98 wherein the alloy contains about 8 to 10% zinc, about 1.5 to 2.5% magnesium, about 2 to 3% copper and about 0.03 to 0.2% zirconium.

102. The method according to claim 98 wherein the alloy contains about 10.5 to 12% zinc, about 1.8 to 2.8% magnesium, about 1 to 2% copper and about 0.03 to 0.2% zirconium.

103. A method for treating a 7XXX aluminum alloy containing about 7 to 12% zinc, about 1.5 to 2.7% magnesium, about 1 to 3% copper, and up to about 1% of one or more elements selected from zirconium, chromium, manganese, vanadium and hafnium, said method comprising:

(a) providing the alloy in a solution heat treated condition;

(b) subjecting the alloy to one or more temperatures within about 175° to 325° F. for a substantial cumulative time within about 175° to 325° F.;

(c) increasing the temperature of said alloy and subjecting it to one or more temperatures within about 340° to 500° F. for a cumulative time within 340° to 500° F. from about four minutes or more to about two and one-half hours; and (d) subjecting the alloy to one or more temperatures within about 175° to 325° F. for a cumulative time within about 175° to 325° F.;

(e) said subjecting in recitation (c) not being excessive to imparting a significant strength increase to the alloy in recitation (d).

104. The method according to claim 103 wherein said substantial cumulative time within about 175° to 325° F. in recitation (b) is about 3 hours or more.

105. The method according to claim 103 wherein said cumulative time within about 175° to 325° F. in recitation (d) is about 2 hours or more.

106. The method according to claim 103 wherein said subjecting in recitation (c) imparts time-temperature equivalence substantially within ABCD of FIG. 4.

107. The method according to claim 103 wherein said subjecting in recitation (c) imparts time-temperature equivalence substantially within EFGH of FIG. 4.

108. The method according to claim 103 wherein said subjecting in recitation (c) imparts time-temperature equivalence substantially within JKLM of FIG. 5.

109. The method according to claim 103 wherein the alloy contains about 7 to 9.5% zinc, about 1.5 to 2.5% magnesium, about 1.8 to 3% copper and about 0.03 to 0.2% zirconium.

110. The method according to claim 103 wherein the alloy contains about 9.5 to 11.5% zinc, about 1.5 to 2.5% magnesium, about 1 to 2% copper and about 0.3 to 0.2% zirconium.

111. The method according to claim 103 wherein the alloy contains about 8 to 10% zinc, about 1.5 to 2.5% magnesium, about 2 to 3% copper and about 0.03 to 0.2% zirconium.

112. The method according to claim 103 wherein the alloy contains about 10.5 to 12% zinc, about 1.8 to 2.8% magnesium, about 1 to 2% copper and about 0.03 to 0.2% zirconium.

113. A method for treating a 7XXX alloy containing about7 to 12% zinc, about 1.5 to 2.7% magnesium, about 1 to 3% copper, up to about 1% of one or more elements selected from zirconium, chromium, manganese, vanadium and hafnium, the balance aluminum and incidental elements and impurities, said method comprising:

(a) providing the alloy in a wrought precipitation-hardenable condition;

(b) subjecting the alloy to one or more temperatures within about 175° to 325° F. for a cumulative time within about 175° to 325° F. of about 3 hours or more;

(c) increasing the temperature of said alloy and subjecting it to one or more temperatures within about 340° to 500° F. for a cumulative time within 340° to 500° F. from about 5 minutes to about two and one-half hours to impart to said alloy time-temperature equivalence substantially within JKLM of FIG. 5; and (d) subjecting the alloy to one or more temperatures within about 175° to 325° F. for a cumulative time within about 175° to 325° F. of about two hours or more.

114. The method according to claim 113 wherein the alloy contains about 7 to 9.5% zinc, about 1.5 to 2.5% magnesium, about 1.8 to 3% copper and about 0.03 to 0.2% zirconium.

115. The method according to claim 113 wherein the alloy contains about 9.5 to 11.5% zinc, about 1.5 to 2.5% magnesium, about 1 to 2% copper and about 0.03 to 0.2% zirconium.

116. The method according to claim 113 wherein the alloy contains about 8 to 10% zinc, about 1.5 to 2.5% magnesium, about 2 to 3% copper and about 0.03 to 0.2% zirconium.

117. The method according to claim 113 wherein the alloy contains about 10.5 to 12% zinc, about 1.8 to 2.8% magnesium, about 1 to 2% copper and about 0.03 to 0.2% zirconium.

118. A method for imparting improved combinations of strength, toughness and corrosion resistance to a solution-heat-treated alloy product consisting essentially of about 7 to 12% zinc, about 1.5 to 2.7% magnesium, about 1 to 3% copper, and up to about 1% of one or more elements selected from zirconium, chromium, manganese, vanadium and hafnium, the balance aluminum and incidental elements and impurities, said method comprising: (a) treating the alloy product at more than one elevated temperature to: (i) form hardening precipitates; and (ii) improve its corrosion resistance, said treatment including heating within about 360°–500° F. for greater than three minutes to impart a cumulative time-temperature effect substantially within JKLM of FIG. 5; and (b) precipitation hardening the alloy product including heating at one or more temperatures between about 175°–325° F. to increase its strength.

119. The method as claimed in claim 118 wherein recitation (a)(i) includes treating the alloy product for at least about two hours between about 175°–325° F. to form hardening precipitates before heating for said cumulative time-temperature effect.

120. The product produced by the method of claim 1.

121. The product produced by the method of claim 21.

122. The product produced by the method of claim 27.

123. The product produced by the method of claim 53.

124. The product produced by the method of claim 57.

125. The product produced by the method of claim 60.

126. The product produced by the method of claim 75.

127. The product produced by the method of claim 86.

128. The product produced by the method of claim 91.

129. The product produced by the method of claim 98.

130. The product produced by the method of claim 103.

131. The product produced by the method of claim 113.

132. The product produced by the method of claim 118.

133. The product produced by the method of claim 123.

* * * * *